US012460486B2

(12) United States Patent
Kunec et al.

(10) Patent No.: US 12,460,486 B2
(45) Date of Patent: Nov. 4, 2025

(54) TUBULAR HANDLING SYSTEM

(71) Applicant: Nabors Drilling Technologies USA, Inc., Houston, TX (US)

(72) Inventors: Alex Kunec, Conroe, TX (US); Ashish Gupta, Houston, TX (US); Keith Hager, Spring, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 18/591,936

(22) Filed: Feb. 29, 2024

(65) Prior Publication Data

US 2024/0295151 A1 Sep. 5, 2024

Related U.S. Application Data

(60) Provisional application No. 63/488,003, filed on Mar. 2, 2023.

(51) Int. Cl.
*E21B 19/15* (2006.01)

(52) U.S. Cl.
CPC ..... *E21B 19/155* (2013.01)

(58) Field of Classification Search
CPC ..... E21B 19/155; E21B 19/15; A01G 23/062; E04H 17/265; E04H 12/347
USPC .. 414/23, 22.71, 22.51, 22.52, 22.53, 22.54, 414/22.55, 22.56, 22.57, 22.58, 22.59, 414/22.61, 22.62, 22.63, 22.64, 22.65,
(Continued)

(56) References Cited

U.S. PATENT DOCUMENTS 3,404,741 A * 10/1968 Gheorghe et al. ..... E21B 19/20 175/85
4,013,178 A * 3/1977 Brown ..... E21B 19/07 901/17

(Continued)

FOREIGN PATENT DOCUMENTS

CN 103388462 A 11/2013
CN 206608120 U 11/2017
EP 1103695 A2 * 5/2001 ..... E21B 15/00

OTHER PUBLICATIONS

SmartRacker—Vertical pipe-handling system, Cameron, https://www.slb.com/-/media/files/cam-drlg-re/product-sheet/smartracker-pipe-handling-system-ps.ashx, 2016, 2 pages.

(Continued)

*Primary Examiner* — Gregory W Adams
(74) *Attorney, Agent, or Firm* — Abel Schillinger, LLP

(57) ABSTRACT

A system that can include a vertical support rotationally coupled to a rig floor, a hoisting arm movably coupled to the vertical support, and a catwalk, wherein the hoisting arm is configured to transport the tubular between the catwalk and well center or mousehole while the vertical support maintains a substantially constant azimuthal orientation. A method can include movably coupling a vertical support to an upper track, extending an upper tailing arm a first horizontal distance from the vertical support to engage an upper portion of a tubular, retracting the upper tailing arm to move the upper portion of the tubular proximate the vertical support, and extending a hoisting arm a second horizontal distance to engage a middle portion of the tubular, wherein the second horizontal distance is less than the first horizontal distance.

12 Claims, 30 Drawing Sheets

(58) Field of Classification Search
USPC ..... 414/22.66, 22.67, 22.68, 22.69; 175/52, 175/85
See application file for complete search history.

(56) References Cited

U.S. PATENT DOCUMENTS

| | | | | |
|---|---|---|---|---|
| 4,610,315 | A * | 9/1986 | Koga | E21B 19/20 175/203 |
| 4,715,761 | A * | 12/1987 | Berry | E21B 19/14 901/17 |
| 8,397,837 | B2 * | 3/2013 | Skogerbo | G05B 19/4061 166/341 |
| 9,382,768 | B2 | 7/2016 | Garber et al. | |
| 9,752,395 | B2 * | 9/2017 | Roodenburg | E21B 15/00 |
| 9,863,194 | B2 * | 1/2018 | Larkin | E21B 19/155 |
| 10,323,473 | B2 * | 6/2019 | Magnuson | E21B 19/00 |
| 10,612,323 | B2 * | 4/2020 | Childers | E21B 19/20 |
| 10,837,243 | B2 * | 11/2020 | Magnuson | E21B 15/00 |
| 2006/0054162 | A1 * | 3/2006 | Romeo | F24S 50/20 126/600 |
| 2009/0196712 | A1 | 8/2009 | Mortensen et al. | |
| 2010/0021271 | A1 | 1/2010 | Littlely | |
| 2014/0202769 | A1 | 7/2014 | Magnuson | |
| 2015/0152697 | A1 | 6/2015 | Gustavsson | |
| 2016/0060981 | A1 | 3/2016 | Larkin | |
| 2016/0090796 | A1 | 3/2016 | Roodenburg et al. | |
| 2016/0116376 | A1 | 4/2016 | Roodenburg | |
| 2017/0314347 | A1 | 11/2017 | Barnes | |
| 2019/0383109 | A1 | 12/2019 | Rus | |
| 2020/0199949 | A1 | 6/2020 | Magnuson | |
| 2021/0002995 | A1 | 1/2021 | Botnan et al. | |
| 2021/0054700 | A1 * | 2/2021 | Basile | E21B 19/14 |
| 2021/0071485 | A1 * | 3/2021 | Mikalsen | E21B 19/16 |

OTHER PUBLICATIONS

Parallel Racking Pipe Handling, Technical Marketing Sheet, NOV Rig Technologies, https://www.nov.com/media/nov/files/products/rig/rig-equipment/pipe-handling-systems/parallel-racking-pipe-handling-spec-sheet.pdf, last accessed Jun. 11, 2024, 1 page.
International Search Report and Written Opinion for PCT/US2024/017867, mailed Jun. 13, 2024, 11 pages.

* cited by examiner

CROSS-SECTION ALONG LINE 5-5

CROSS-SECTION ALONG LINE 5-5

TUBULAR HANDLING SYSTEM

CROSS-REFERENCE TO RELATED APPLICATION(S)

This application claims priority under 35 U.S.C. § 119(e) to U.S. Provisional Application No. 63/488,003, entitled "TUBULAR HANDLING SYSTEM," by Alex KUNEC, et al., filed Mar. 2, 2023, which is assigned to the current assignee hereof and incorporated herein by reference in its entirety.

FIELD OF THE DISCLOSURE

The present invention relates, in general, to the field of drilling and processing of wells. More particularly, present embodiments relate to a system and method for manipulating tubulars during subterranean operations.

BACKGROUND

In subterranean operations, a segmented tubular string can be used to access hydrocarbon reserves in an earthen formation. The segmented tubular string can be made up of individual tubular segments or stands of tubular segments. As tubular segments or tubular stands are assembled together to form the tubular string, the tubular string can be extended further into the wellbore at the well site, which can be referred to as "tripping in" the tubular string. When the tubular string needs to be at least partially removed from the wellbore, individual tubular segments or tubular stands can be removed from the top end of the tubular string as the tubular string is pulled up from the wellbore. This can be referred to as "tripping out" the tubular string.

Due to the large number of tubular segments needed during the tripping operations, tubular storage areas near or on the rig can be utilized to improve efficiency of rig operations. Many rigs can have a horizontal storage area positioned on a V-door side of the rig with tubulars stored in a horizontal orientation. The rigs can also include a fingerboard vertical storage normally on the rig floor for holding tubulars in a vertical orientation. As used herein, a "horizontal orientation" or "horizontal position" refers to a horizontal plane that is generally parallel to a horizontal plane of a rig floor (e.g., X-Y plane shown in FIG. 2), where the horizontal plane can be any plane that is within a range of "0" degrees+/−10 degrees from the horizontal plane of the rig floor. As used herein, a "vertical orientation" or "vertical position" refers to a vertical direction (e.g., Z direction shown in FIG. 2) that is generally perpendicular to the horizontal plane of the rig floor, where the vertical direction can be any direction that is within a range of 90 degrees+/−10 degrees from the horizontal plane of the rig floor. As used herein, an "inclined orientation" or "inclined position" refers to a plane that is generally angled relative to the horizontal plane of the rig floor, where the inclined plane can be any plane that is within a range from 10 degrees up to and including 80 degrees rotated from the horizontal plane of the rig floor.

Tubular handling systems are used to move the tubulars between the horizontal storage area, the vertical storage area, the mousehole, and the well center as needed during rig operations. The efficiency of these tubular handling systems can greatly impact the overall efficiency of the rig during subterranean operations. Therefore, improvements in these tubular handling systems are continually needed.

SUMMARY

This summary is provided to introduce a selection of concepts that are further described below in the detailed description. This summary is not intended to identify indispensable features of the claimed subject matter, nor is it intended for use as an aid in limiting the scope of the claimed subject matter.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a system for handling tubulars in a subterranean operation. The system also includes a vertical support coupled to a rig floor and configured to rotate around a center axis of the vertical support relative to the rig floor; a hoisting arm movably coupled to the vertical support; and a catwalk configured to transport a tubular between a horizontal storage area and the rig floor, and where the hoisting arm is configured to transport the tubular between the catwalk and a well center or between the catwalk and a mousehole, where the vertical support is at a first azimuthal orientation relative to the center axis when the hoisting arm receives the tubular from the catwalk or delivers the tubular to the catwalk, where the vertical support is at a second azimuthal orientation relative to the center axis when the hoisting arm receives the tubular from a well center or mousehole, or delivers the tubular to the well center or mousehole, and where the first azimuthal orientation is substantially equal to the second azimuthal orientation. Other embodiments of this aspect include corresponding computer systems, apparatus, and computer programs recorded on one or more computer storage devices, each configured to perform the actions of the methods.

One general aspect includes a method for handling tubulars in a subterranean operation. The method also includes movably coupling a vertical support of a pipe handler to a rig floor, such that the vertical support is configured to horizontally translate along the rig floor and to rotate around a center axis relative to the rig floor; movably coupling a hoisting arm to the vertical support; extending a portion of a tubular from a catwalk along a center line of the catwalk to vertically below the hoisting arm; engaging the portion of the tubular via the hoisting arm; and via the hoisting arm, receiving the tubular from the catwalk or delivering the tubular to the catwalk at a first azimuthal orientation; and via the hoisting arm, delivering the tubular to or receiving the tubular from a delivery location on the rig floor at a second azimuthal orientation, where the first azimuthal orientation is substantially equal to the second azimuthal orientation. Other embodiments of this aspect include corresponding computer systems, apparatus, and computer programs recorded on one or more computer storage devices, each configured to perform the actions of the methods.

One general aspect includes a system for handling tubulars in a subterranean operation. The system also includes a vertical storage area configured to store vertically oriented tubulars on a rig floor; a vertical support of a pipe handler movably coupled to the rig floor and a fingerboard; an upper tailing arm rotationally coupled to an upper portion of the vertical support, where the upper tailing arm is configured to extend a maximum first horizontal distance from the vertical support; and a hoisting arm moveably coupled to the vertical support below the upper tailing arm, where the hoisting arm is configured to lift an entire weight of a tubular, where the hoisting arm is configured to extend a maximum second horizontal distance from the vertical support, and where the first maximum horizontal distance is greater than the second maximum horizontal distance. Other embodiments of this aspect include corresponding computer systems, apparatus, and computer programs recorded on one or more computer storage devices, each configured to perform the actions of the methods.

One general aspect includes a method for handling tubulars in a subterranean operation. The method also includes movably coupling a vertical support of a pipe handler to an upper track in a fingerboard; extending an upper tailing arm a first horizontal distance from the vertical support and engaging an upper portion of a tubular with the upper tailing arm, where the upper tailing arm is coupled to the vertical support, and where the tubular is positioned in a location of a vertical storage area; retracting the upper tailing arm to move the upper portion of the tubular proximate the vertical support; and extending a hoisting arm a second horizontal distance to engage a middle portion of the tubular, where the hoisting arm is coupled to the vertical support, and where the second horizontal distance is less than the first horizontal distance. Other embodiments of this aspect include corresponding computer systems, apparatus, and computer programs recorded on one or more computer storage devices, each configured to perform the actions of the methods.

One general aspect includes a system for handling tubulars in a subterranean operation. The system also includes a catwalk configured to transport a tubular between a horizontal storage area and a rig floor; and a vertical support coupled to a rig floor via an angled lower track, where the vertical support is configured to rotate around a center axis of the vertical support relative to the rig floor and translate along the angled lower track, where the angled lower track is horizontally angled relative to a center line of the catwalk; and a hoisting arm movably coupled to the vertical support, where the hoisting arm is configured to transport the tubular between the catwalk and a well center or between the catwalk and a mousehole along the angled lower track. Other embodiments of this aspect include corresponding computer systems, apparatus, and computer programs recorded on one or more computer storage devices, each configured to perform the actions of the methods.

One general aspect includes a method for handling tubulars in a subterranean operation. The method also includes movably coupling a vertical support of a pipe handler to an upper track in a fingerboard and a lower track on a rig floor, where the upper track and the lower track are substantially parallel with each other, and where the upper track and the lower track are horizontally angled relative to a center line of a catwalk; receiving or retrieving a tubular from a pickup location via the pipe handler by engaging the tubular with the pipe handler, holding the tubular in a vertical orientation at a first radial distance from a center axis of the vertical support, transporting the tubular along the upper track and the lower track, and delivering the tubular to a delivery location via the pipe handler. Other embodiments of this aspect include corresponding computer systems, apparatus, and computer programs recorded on one or more computer storage devices, each configured to perform the actions of the methods.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", "generally", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

Figure 1:
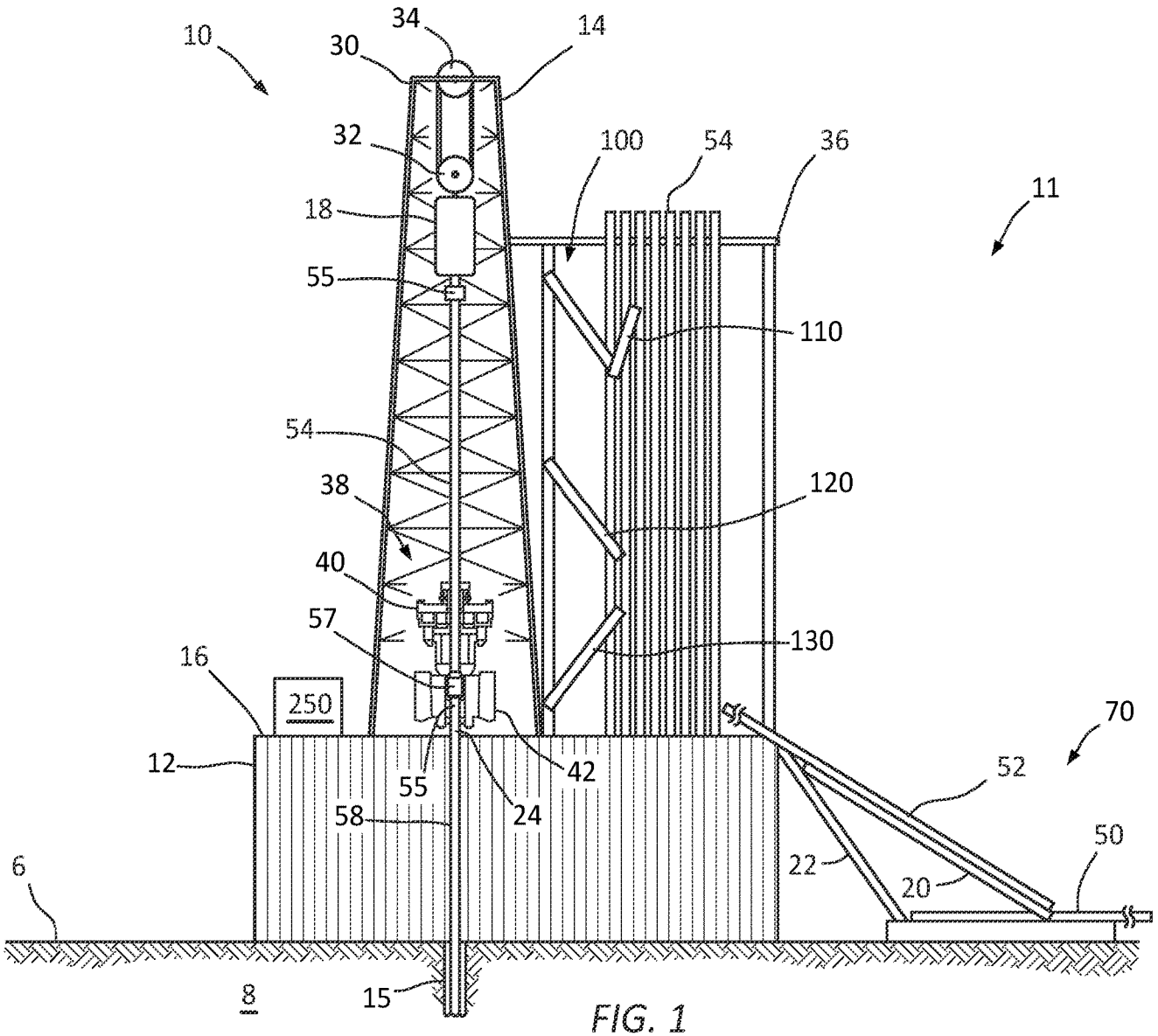
FIG. 1 is a representative simplified side view of a rig with a pipe handler for performing a subterranean operation, in accordance with certain embodiments.

As used herein, "tubular" refers to an elongated cylindrical tube and can include any of the tubulars manipulated around a rig, such as tubular segments, tubular stands, tubulars, and tubular string, but not limited to the tubulars shown in FIG. 1. Therefore, in this disclosure, "tubular" is synonymous with "tubular segment," "tubular stand," and "tubular string," as well as "pipe," "pipe segment," "pipe stand," "pipe string," "casing," "casing segment," or "casing string."

FIG. 1 is a representative simplified side view of a rig 10 with a pipe handler 100 being utilized for a subterranean operation (e.g., tripping in or out a tubular string to or from a wellbore 15), in accordance with certain embodiments. The rig 10 can include a platform 12 with a rig floor 16 and a derrick 14 extending up from the rig floor 16. The derrick 14 can provide support for hoisting the top drive 18 as needed to manipulate tubulars, such as sheaves 34 rotationally coupled to a crown 30, with the sheaves 34 coupled to a traveling block 32 for raising and lowering the top drive 18. A catwalk 20 and V-door ramp 22 can be used to transfer horizontally stored tubular segments 50 to the rig floor 16.

A tubular segment 52 can be one of the horizontally stored tubular segments 50 that is being transferred to the rig floor 16 via the catwalk 20. A pipe handler 100, with articulating arms 110, 120, 130, can be used to grab the tubular segment 52 from the catwalk 20 and transfer the tubular segment 52 to the top drive 18, the vertical storage area 36, a well center 24, a mousehole 26 (see FIG. 5), a doping device 48, etc.

As used herein, "tubular" refers to an elongated cylindrical tube and can include any of the tubulars manipulated around the rig 10, such as tubular segments 50, 52, tubular stands, tubulars 54, and tubular string 58, but not limited to the tubulars shown in FIG. 1. Therefore, in this disclosure, "tubular" is synonymous with "tubular segment," "tubular stand," and "tubular string," as well as "pipe," "pipe segment," "pipe stand," "pipe string," "casing," "casing segment," or "casing string." Therefore, tubulars 50, 54 can refer to all types of tubulars indicated here. However, the tubulars 50, 54 can also indicate particular types of tubulars in a non-limiting reference. Such particular types are intended to assist in describing the aspects of the pipe handler 100, such as a tubular 50 can generally indicate a tubular segment stored in a horizontal storage area 70, where a tubular 52 can generally indicate a tubular segment being transported to the rig floor 16 for being assembled into a tubular string 58 or a tubular stand, and where a tubular 54 can generally indicate a tubular stand that is made up of two or more tubular segments 52, but a tubular 54 can also refer to a tubular stand with only one tubular segment, which would be equivalent to referring to the tubular as a tubular 52.

Tubular string 58 can extend into the wellbore 15, with the wellbore 15 extending through the surface 6 into the subterranean formation 8. When tripping the tubular string 58 into the wellbore 15, tubulars 54 are sequentially added to the tubular string 58 to extend the length of the tubular string 58 into the earthen formation 8. FIG. 1 shows a land-based rig. However, it should be understood that the principles of this disclosure are equally applicable to off-shore rigs where "off-shore" refers to a rig with water between the rig floor and the earth surface 6. When tripping the tubular string 58 out of the wellbore 15, tubulars 54 are sequentially removed from the tubular string 58 to reduce the length of the tubular string 58 in the wellbore 15.

When tripping the tubular string 58 into the wellbore 15, the pipe handler 100 can be used to deliver the tubulars 54 to a mousehole 26, a doping device 48, or a well center 24 on the rig floor 16 in a vertical orientation and hand the tubulars 54 off to an iron roughneck 38 or a top drive 18. When tripping the tubular string 58 out of the wellbore 15, the pipe handler 100 can be used to remove the tubulars 54 from the well center 24 in a vertical orientation and receive the tubulars 54 from the iron roughneck 38 or the top drive 18. The iron roughneck 38 can make a threaded connection between a tubular 54 being added and the tubular string 58 at well center 24 or between two tubulars 54 at a mousehole 26 to build a tubular stand. A spinner assembly 40 can engage a body of the tubular 54 to spin a pin end 57 of the tubular 54 into a threaded box end 55 of the tubular string 58 or another tubular 54, thereby threading the tubular 54 into the tubular string 58 or making up a tubular stand. The torque wrench assembly 42 can provide a desired torque to the threaded connection, thereby completing the connection. This process can be reversed when the tubulars 54 are being removed from the tubular string 58.

A rig controller 250 can be used to control the rig 10 operations including controlling various rig equipment, such as the pipe handler 100, the top drive 18, the catwalk 20, the iron roughneck 38, the doping device, mousehole slips 28 at the mousehole 26, the vertical storage area 36 equipment. The rig controller 250 can control the rig equipment autonomously (e.g., without periodic operator interaction,), semi-autonomously (e.g., with limited operator interaction such as initiating a subterranean operation, adjusting parameters during the operation, etc.), or manually (e.g., with the operator interactively controlling the rig equipment via remote control interfaces to perform the subterranean operation). A portion of the rig controller 250 can also be distributed around the rig 10, such as having a portion of the rig controller 250 in the pipe handler 100, in the iron roughneck 38, or around the rig 10 or rig site 11, or at least a portion of the rig controller 250 can be remotely located from the rig site 11 and communicatively coupled to the rig 10 via wired or wireless communication networks.

Figure 2:
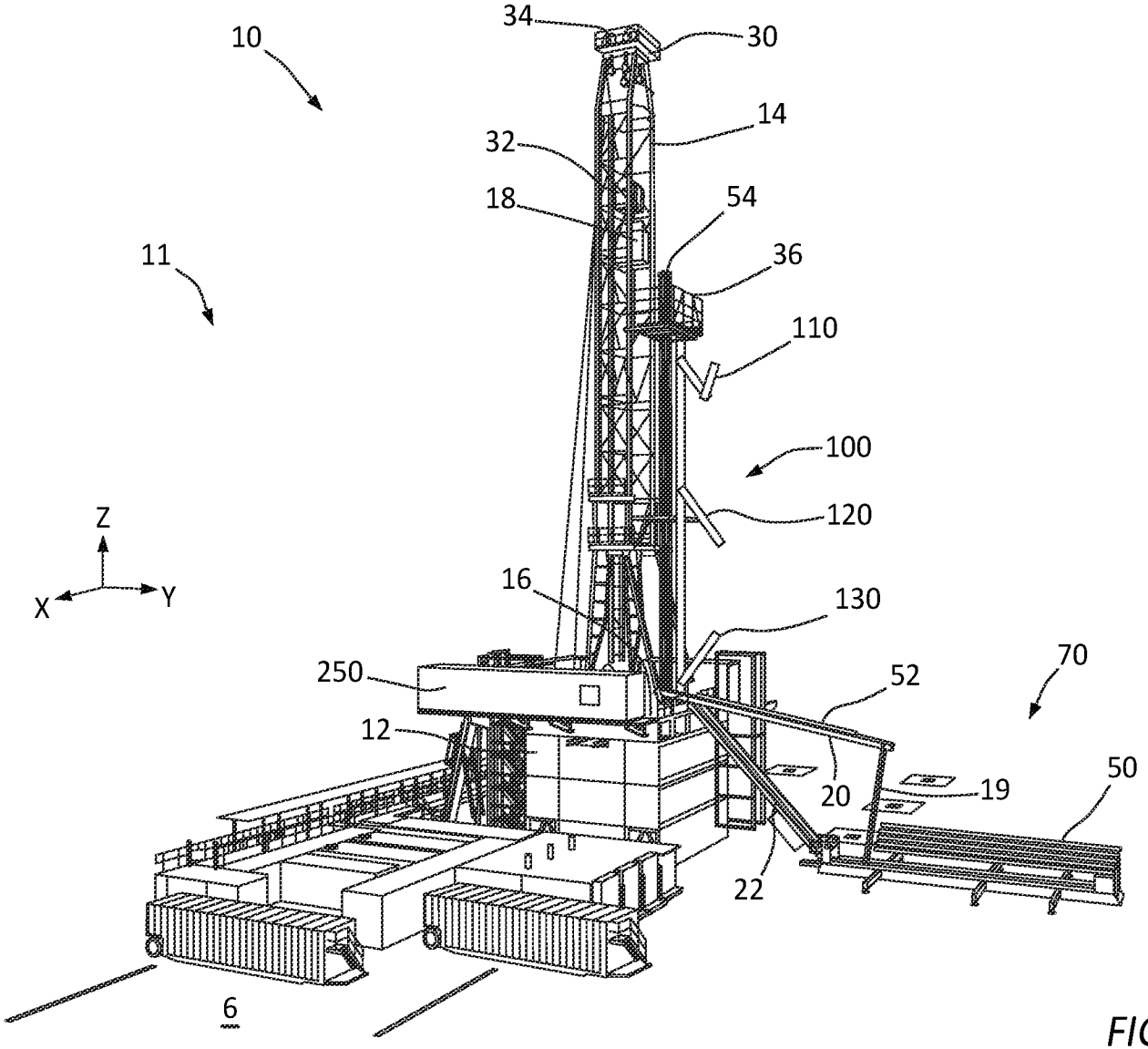
FIG. 2 is a representative perspective view of a rig at a rig site with a pipe handler for performing a subterranean operation, in accordance with certain embodiments.

FIG. 2 is a representative perspective view of a rig 10 at a rig site 11 with a pipe handler 100 for performing a subterranean operation, in accordance with certain embodiments. FIG. 2 illustrates a preferred configuration of the pipe handler 100 on a rig 10, with a catwalk 20 that can deliver a tubular 52 to the rig floor 16 in line with the well center 24 or mousehole 26 (see FIG. 5) and alongside the pipe handler 100, which can collect the tubular 52 from the catwalk 20 and manipulate the tubular 52 about the rig 10 as desired. The catwalk 20 can include a lift arm 19 that can lift an opposite end of the catwalk 20 while the other end of the catwalk 20 is being raised by the V-door ramp 22.

The pipe handler 100 can be moveably coupled at a top end to a fingerboard of the vertical storage area 36 and at a bottom end to the rig floor 16, such that the pipe handler 100 can move along the rig floor 16 to manipulate the tubulars 54 as needed. The pipe handler 100 can include three arms 110, 120, 130, with the upper tailing arm 110 that can be used to control movement of a top end of a tubular 54 (such as in a 90 ft. tubular stand). A lower tailing arm 130 can be used to control movement of a bottom end of a tubular 54 (such as in a tubular 52 or tubular stand 54). A hoisting arm 120 can be used to grip and lift the full weight of the tubular 54 and cooperate with either or both of the upper tailing arm 110 and the lower tailing arm 130 to control movement of the tubular 54.

The upper tailing arm 110 along with the lower tailing arm 130 can be used to assist the hoisting arm 120 in manipulating tubular stands 54 to and from the vertical storage area 36. The lower tailing arm 130 can be used to assist the hoisting arm 120 in transferring tubulars 52 between the pipe handler 100 and the catwalk 20.

Figure 3:
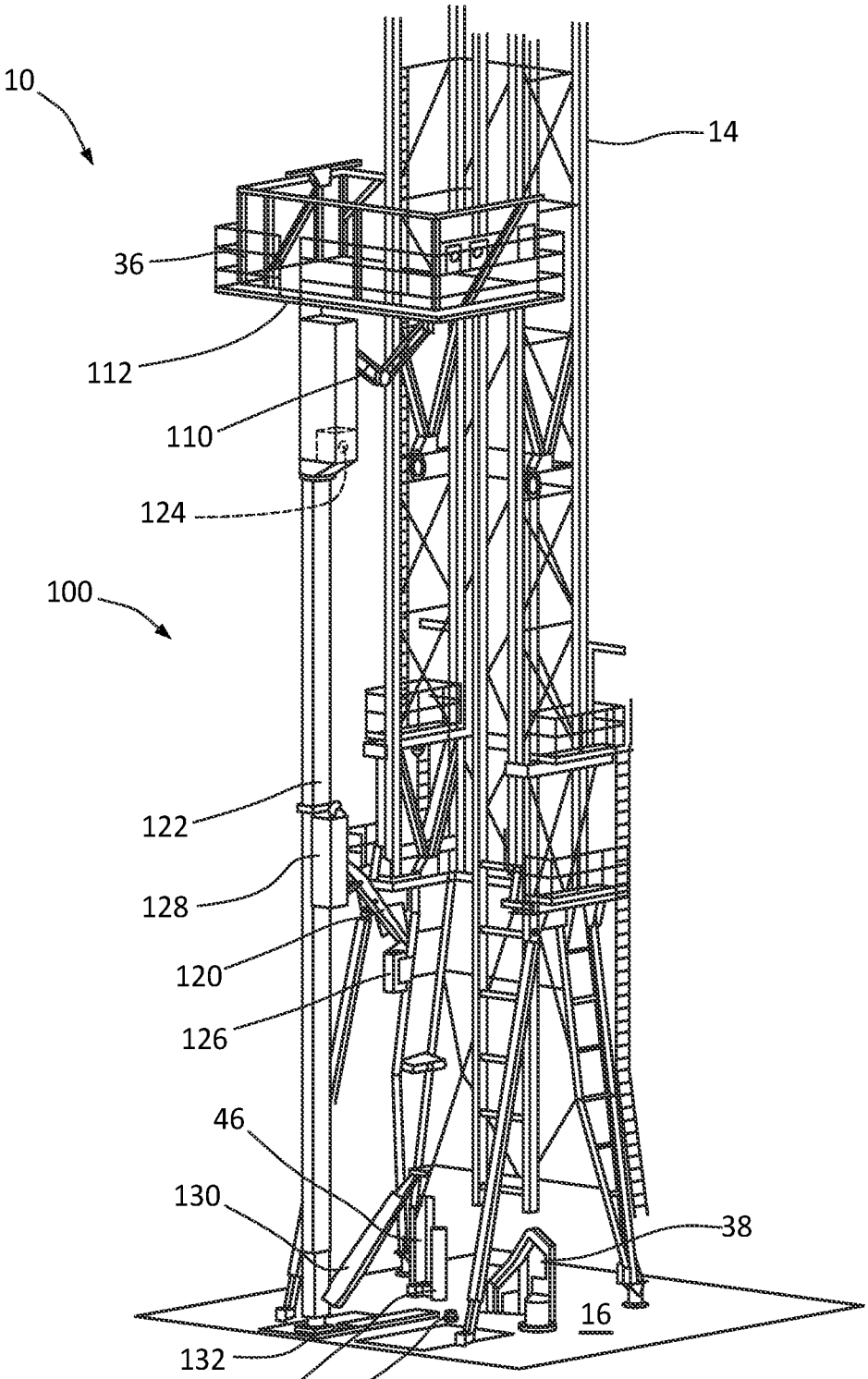
FIG. 3 is a representative perspective view of a rig with a pipe handler for performing a subterranean operation, in accordance with certain embodiments.

FIG. 3 is a representative perspective view of rig 10 with a pipe handler 100 for performing a subterranean operation, in accordance with certain embodiments. The pipe handler 100 can include a vertical support 122 that can be rotationally coupled to an upper track 112 at its top end and to a lower track 132 at its lower end. The vertical support 122 can also travel along the upper and lower tracks 112, 132 from the catwalk 20, along the vertical storage area 36, and toward the well center 24.

The pipe handler 100 can include arms 110, 120, 130 individually coupled to the vertical support 122. The upper tailing arm 110 can be coupled proximate an upper end of the vertical support 122 near the upper track 112. The upper tailing arm 110 can be a multiple segment articulating arm that is capable of reaching the farthest position in the vertical storage area 36 from the vertical support 122 as well as the well center 24. When retracted, the upper tailing arm 110 can be stored in a cavity 114 (see FIG. 9) in the vertical support 122. The upper tailing arm 110 can be fixedly mounted to the vertical support 122 via a base at one end with a gripper 116 at the other end (see FIG. 4). The upper tailing arm 110 can rotate with the vertical support 122, but is preferred that the base is not vertically moveable relative to the vertical support 122. However, it is not a requirement that the base be vertically fixed to the vertical support 122. If desired, the base could move vertically relative to the vertical support 122.

The lower tailing arm 130 can be coupled proximate a lower end of the vertical support 122 near the lower track 132. The lower tailing arm 130 can be an articulating arm that is capable of reaching a farthest position in the vertical storage area 36 from the vertical support 122 as well as the well center 24. The lower tailing arm 130 can rotate with the vertical support 122 as well as rotating relative to the vertical support 122. The lower tailing arm 130 can rotate approximately 180 degrees from a near horizontal orientation above the rig floor 16, through a vertical orientation generally parallel with the vertical support 122, and to a near horizontal orientation over the catwalk 20.

The hoisting arm 120 can be movably coupled to the vertical support 122 via a base 128 and rotationally coupled to the base 128 at one end with a rotatable gripper 126 coupled at an opposite end of the hoisting arm 120. The base 128 can be configured to move vertically along the vertical support 122, where the vertical movement can be controlled by a hoist 124. The hoist 124 can be coupled to the base 128 by any suitable mechanism that allows the hoist 124 to raise or lower the base 128. However, it should also be understood that the hoist 124 is not required. A motor (not shown) can be disposed in the base 128 that engages the vertical support 122 (e.g., via a track) to raise or lower the base 128.

The pipe handler 100 can cooperate with the catwalk 20, the iron roughneck 38, the top drive 18, the mud bucket 44, the vertical storage area 36, mousehole slips 28, and the doping device 48 to trip a tubular string into or out of the wellbore 15.

Figure 4:
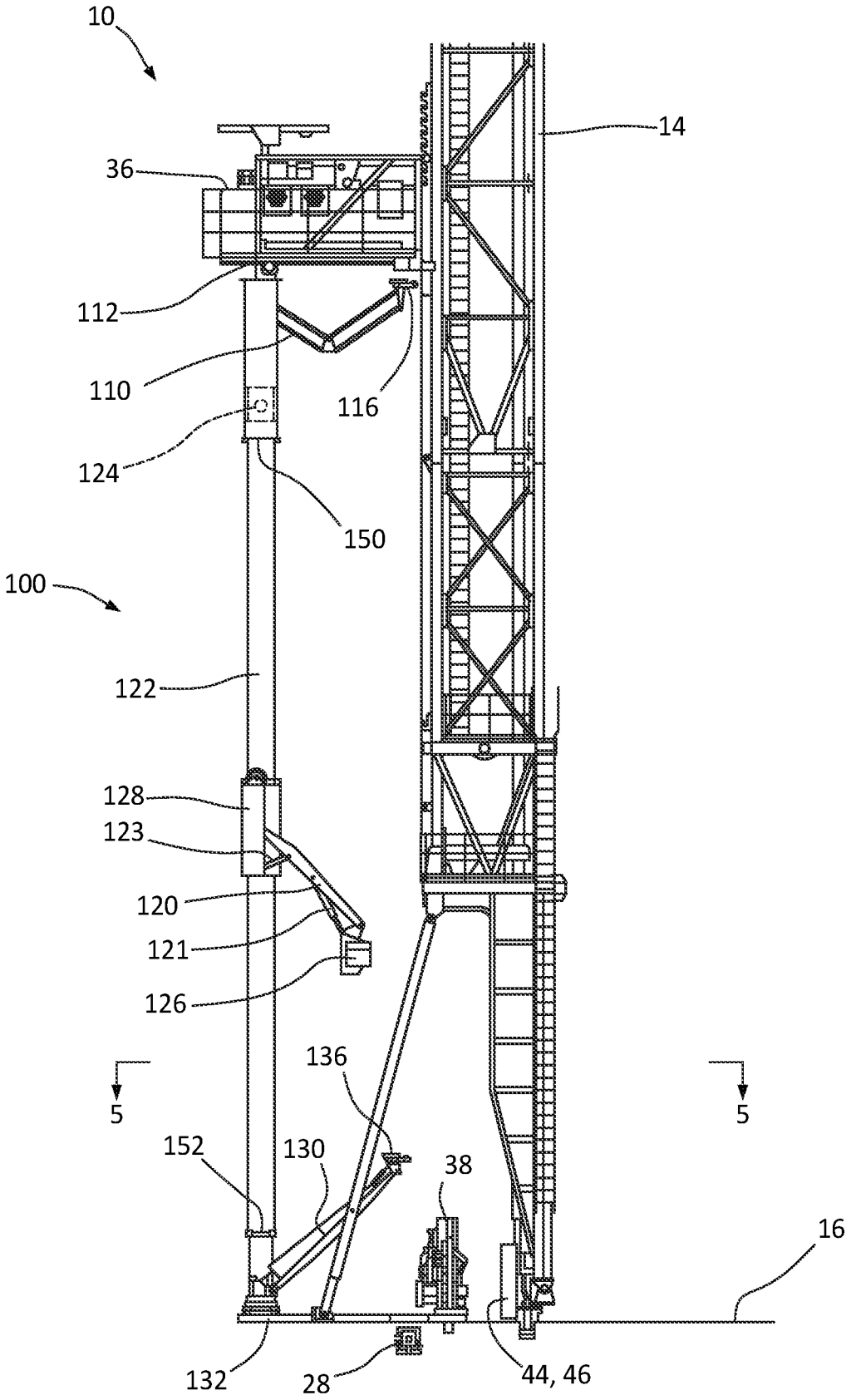
FIG. 4 is a representative side view of a rig with a pipe handler for performing a subterranean operation, in accordance with certain embodiments.

FIG. 4 is a representative side view of rig 10 with a pipe handler 100 for performing a subterranean operation, in accordance with certain embodiments. As can be more easily seen, the arms 110, 120, 130 are extended toward well center. The upper tailing arm 110 can be operated by multiple actuators that cause the multiple segmented arm to extend or retract the gripper 116. The parallelogram configuration of the dual segments allows the gripper 116 to remain positioned to engage a tubular 54, regardless of the extended position of the gripper 116.

The hoisting arm 120 can include base 128 that is vertically moveable relative to the vertical support 122 via the hoist 124, which can move the base 128 up to the stop 150 and down to the stop 152. This provides significant flexibility for the hoisting arm 120 to manipulate tubulars 54 between the catwalk 20, the vertical storage area 36, and the well center 24. The hoisting arm 120 can be rotationally coupled to the base 128 at one end, with an actuator 123 that can control the rotation of the hoisting arm 120 relative to the base 128. A gripper 126 can be rotationally coupled at an opposite end of the hoisting arm 120, where an actuator 121 can be used to control rotation of the gripper 126 about the opposite end of the hoisting arm 120. The hoisting arm 120 is configured to be able to lift the entire weight of the tubular 54 for manipulation about the rig floor 16, with the upper tailing arm 110 and the lower tailing arm 130 being used to secure, stabilize, and manipulate the respective ends of the tubular 54, if needed.

Figure 5:
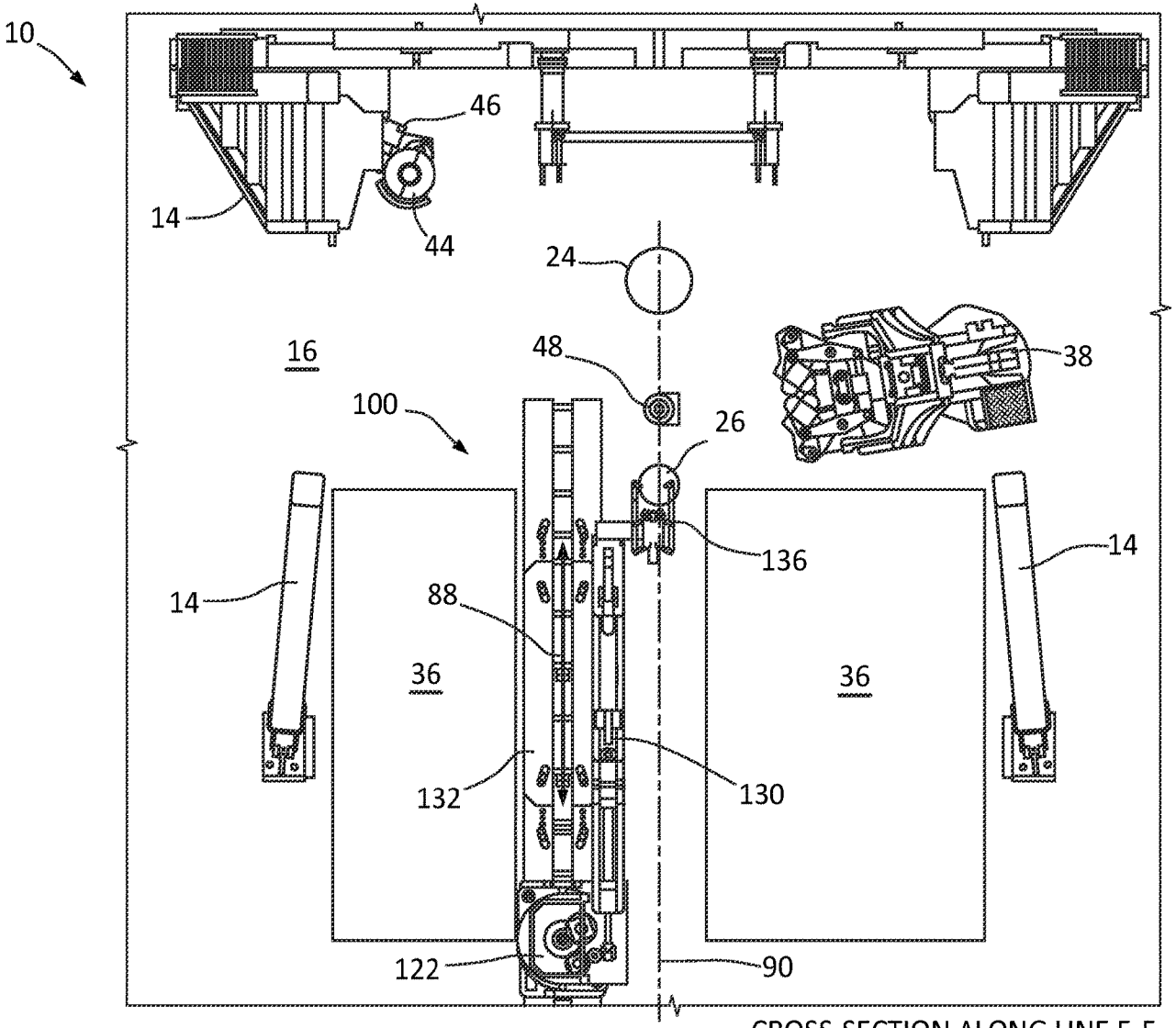
FIG. 5 is a representative partial cross-sectional view 5-5, as indicated in FIG. 4, of the rig with a pipe handler for performing a subterranean operation, in accordance with certain embodiments.

FIG. 5 is a representative partial cross-sectional view 5-5, as indicated in FIG. 4, of the rig 10 with a pipe handler 100 for performing a subterranean operation, in accordance with certain embodiments. The vertical support 122 can move (arrows 88) along the lower track 132 (and the upper track 112, not shown) toward and away from the well center 24. The upper track 112 and the lower track 132 can be offset from the center line 90 of the catwalk 20, which is in line with the mousehole 26, the doping device 48 (if used), and the well center 24. The arms 110, 120, 130 can be positioned on a side of the vertical support 122 to engage tubulars 54 that are aligned with the center line 90. The lower tailing arm 130 is shown rotated such that the gripper 136 is positioned above the mousehole 26. If a tubular 54 were being held by the pipe handler 100, then it could lower the tubular 54 into the mousehole 26 or retrieve the tubular 54 from the mousehole. As can be seen, the pipe handler 100 can be moved to access any of the mousehole 26, doping device 48, and the well center 24, as well as being rotated to access the tubular storage locations in the vertical storage area 36, a top drive 18, or an iron roughneck 38.

The iron roughneck 38 can be extended to makeup or breakup tubular joints 56 at the mousehole 26 or the well center 24. The mud bucket 44 can be extended, via the drill floor arm 46, to access a tubular joint 56 at well center 24, such as when the tubular string 58 is being tripped out of the wellbore 15, and receive fluid expelled from the tubular string 58 when the top tubular 54 of the tubular string 58 is removed from the tubular string 58. Both the mud bucket 44 and the iron roughneck 38 can be retracted to a stowed position when not needed.

Figure 6:
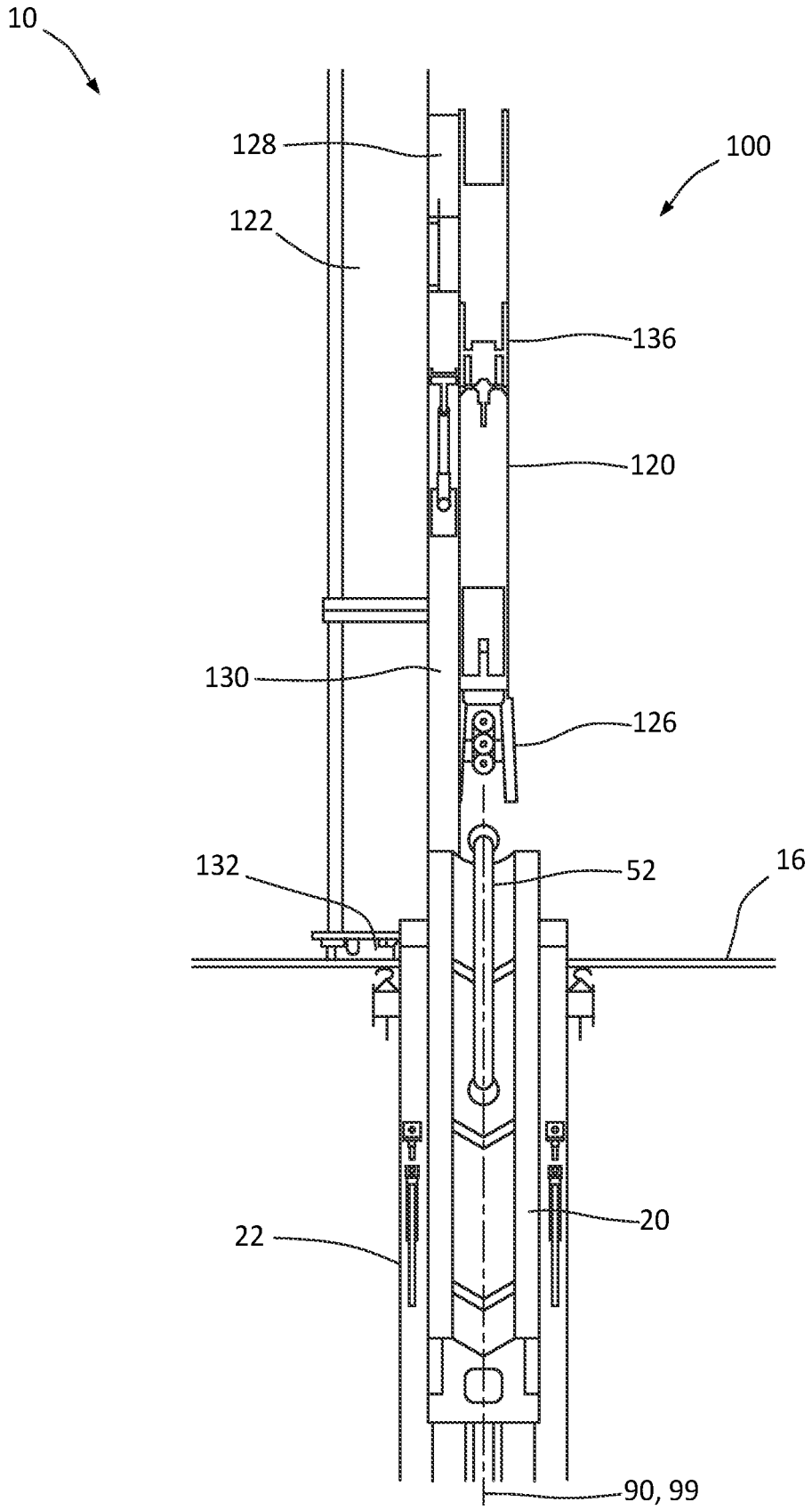
FIG. 6 is a representative side view of a pipe handler as viewed from a catwalk side of the rig, with the pipe handler offset from a center line of a catwalk, in accordance with certain embodiments.
Figure 7:
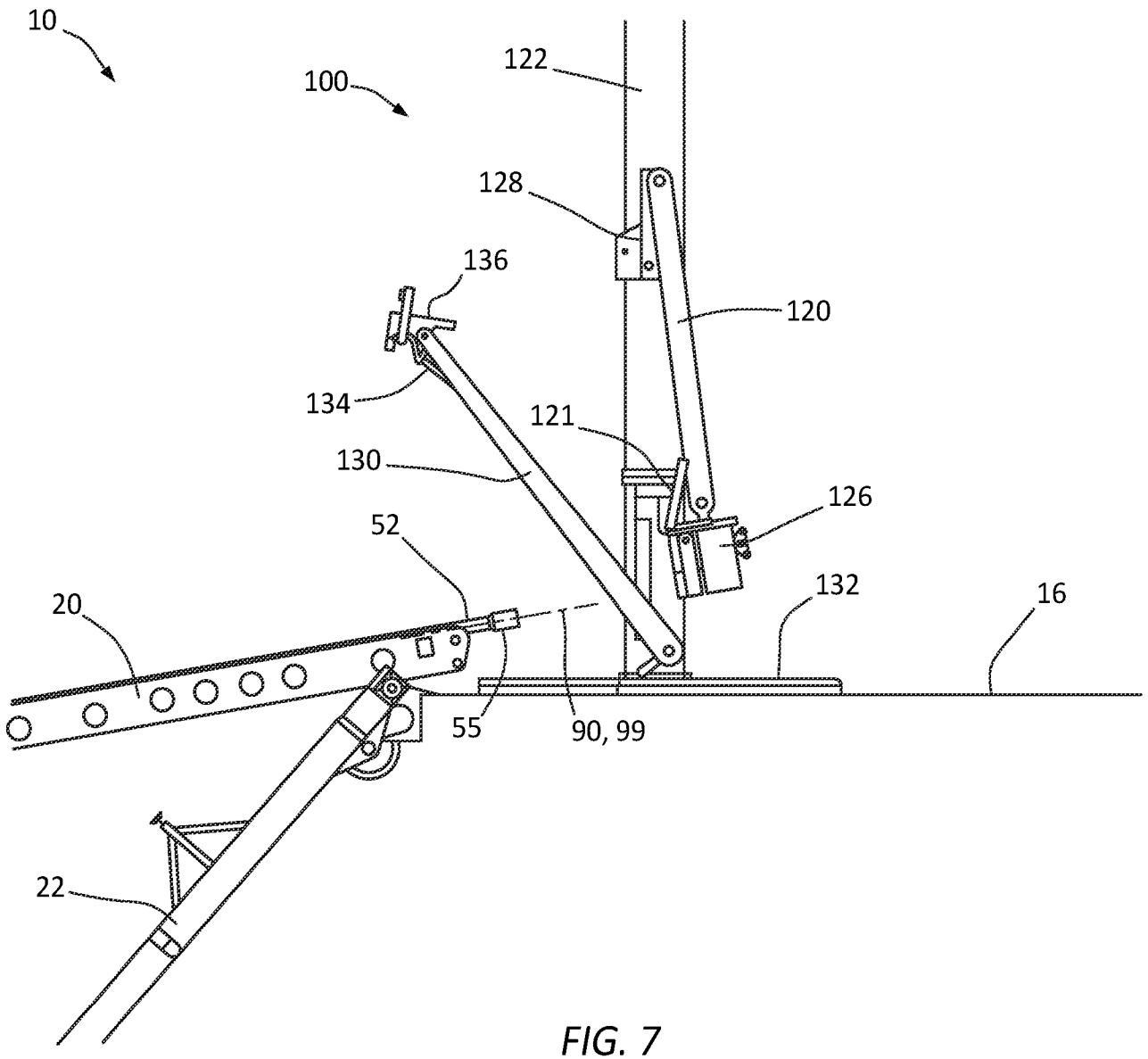
FIG. 7 is a representative side view of a catwalk delivering a tubular to a pipe handler on a rig floor, in accordance with certain embodiments.

FIG. 6 is a representative side view of a pipe handler 100 as viewed from a catwalk side of the rig 10, with the vertical support 122 of the pipe handler 100 being offset from a center line 90 of a catwalk 20, in accordance with certain embodiments. With the vertical support 122 rotated to the desired azimuthal position, the grippers 116, 126, 136 of the arms 110, 120, 130, respectively, can be in line with the center line 90 of the catwalk 20. FIG. 7 is a representative side view of the catwalk 20 which is delivering a tubular 52 to the pipe handler 100 on the rig floor 16, in accordance with certain embodiments. FIGS. 6 and 7 can be seen as side views of the pipe handler 100 and the rig floor 16 that are horizontally rotated 90 degrees with respect to each other.

In a non-limiting embodiment, the catwalk 20 is delivering a tubular 52 with a center axis 99 that is generally aligned with the center line 90 of the catwalk 20. The lower tailing arm 130 has been rotated back so that the gripper 136 is positioned directly over the tubular 52 in the catwalk 20 and positioned vertically above the tubular 52. The gripper 136 is positioned away from the well center 24 enough so that it is safely out of the way of the tubular 52 when the hoisting arm 120 with gripper 126 lifts the tubular 52 from the catwalk 20. The gripper 136 can be rotated (arrows 85) about a pivot axis 95 (see FIG. 8A) by an actuator 134 to control the orientation of the gripper 136 during operations.

The hoisting arm 120 has been lowered by the hoist 124 to a vertical position that allows the gripper 126 access to the tubular 52 as it is presented from the catwalk 20. The gripper 126 can be rotated by the actuator 121 to align the gripper 126 with the center line 90 of the catwalk 20 and the center axis 99 of the tubular 52. The tubular 52 can be extended from the catwalk 20 along the center line 90 of the catwalk 20 towards the well center 24 until the gripper 126 is able to grip the tubular 52 at a desired location along the tubular 52. The following discussion regarding FIGS. 8A-8J, describe in more detail the process of receiving a tubular 52 from the catwalk 20, raising it to a vertical orientation, and presenting it to either the mousehole 26, the doping device 48, or the well center 24, according to a certain embodiment. The pipe handler 100 can also receive the tubular and transport it to the vertical storage area 36, but this process is not illustrated in FIGS. 8A-8J.

Figure 8A:
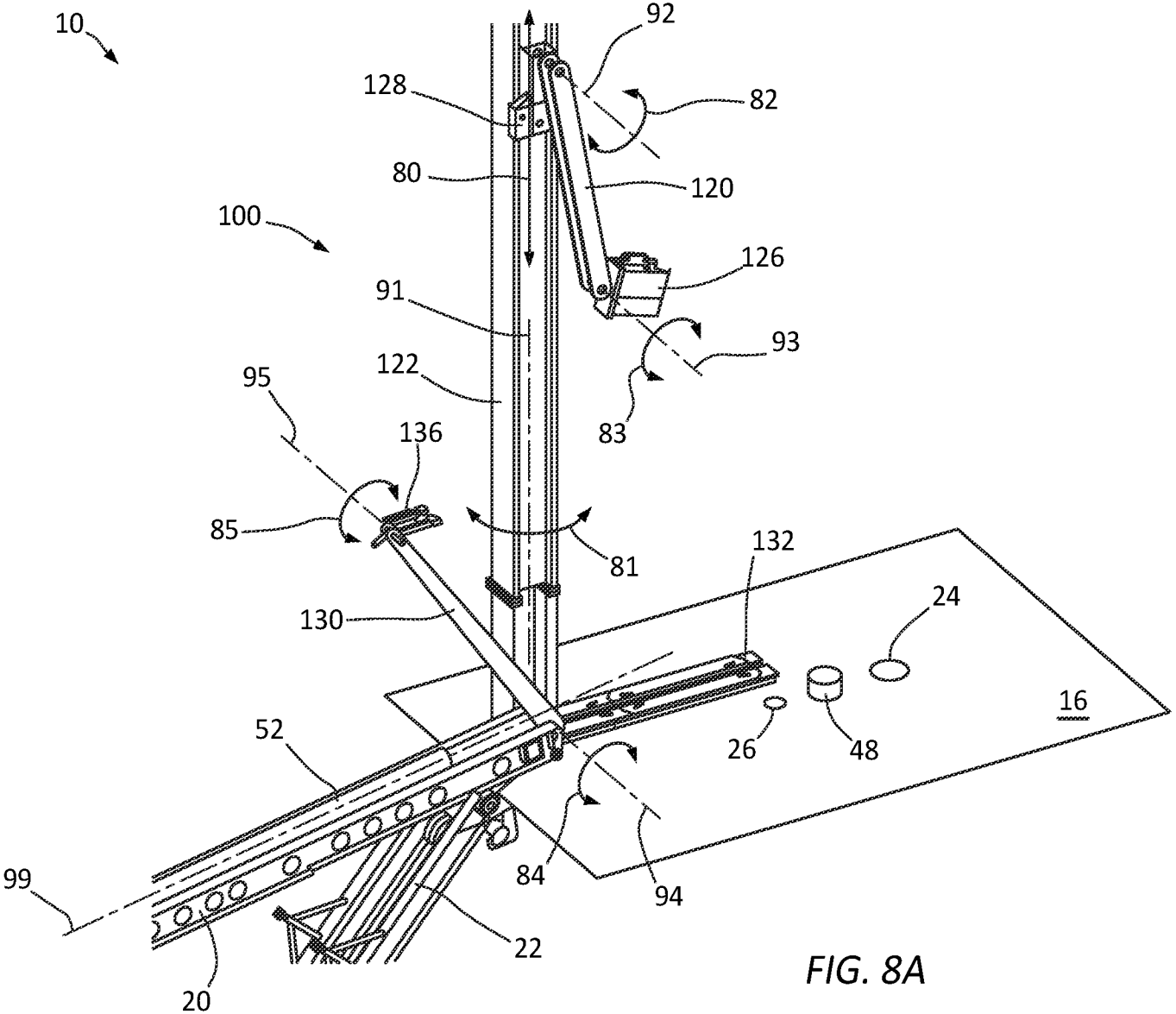
FIGS. 8A-8J are representative perspective or side views of a pipe handler receiving a tubular from a catwalk and transporting the tubular to a mousehole or well center, in accordance with certain embodiments.

FIG. 8A is a representative perspective view of a pipe handler 100 receiving a tubular 52 from a catwalk 20 and transporting the tubular 52 to a mousehole 26, doping device 48, or a well center 24, in accordance with certain embodiments. As mentioned above, the hoisting arm 120 can move vertically along the vertical support 122 via the hoist 124 raising or lowering the base 128 (arrows 80). The one end of the hoisting arm 120 can be rotationally coupled to the base 128 at the pivot axis 92 and can be rotated (arrows 82) about the pivot axis 92 via the actuator 123 (see FIG. 4). The opposite end of the hoisting arm 120 can be rotationally coupled to the gripper 126 at the pivot axis 93 and can be rotated (arrows 83) about the pivot axis 93 via the actuator 121 (see FIG. 4).

The vertical support 122 can be rotated (arrows 81) about the pivot axis 91, thereby rotating the arms 110, 120, 130 about the pivot axis 91 as needed to manipulate a tubular about the rig floor 16 when one or more of the arms are engaged with the tubular 52. One end of the lower tailing arm 130 can be rotationally coupled to the lower end of the vertical support 122 at the pivot axis 94 and can be rotated (arrows 84) about the pivot axis 94 via an actuator, such as a motor (not shown). The lower tailing arm 130 has been positioned to receive the tubular 52 from the catwalk 20, and the hoisting arm 120 is being lowered to a position to engage the tubular 52.

Figure 8B:
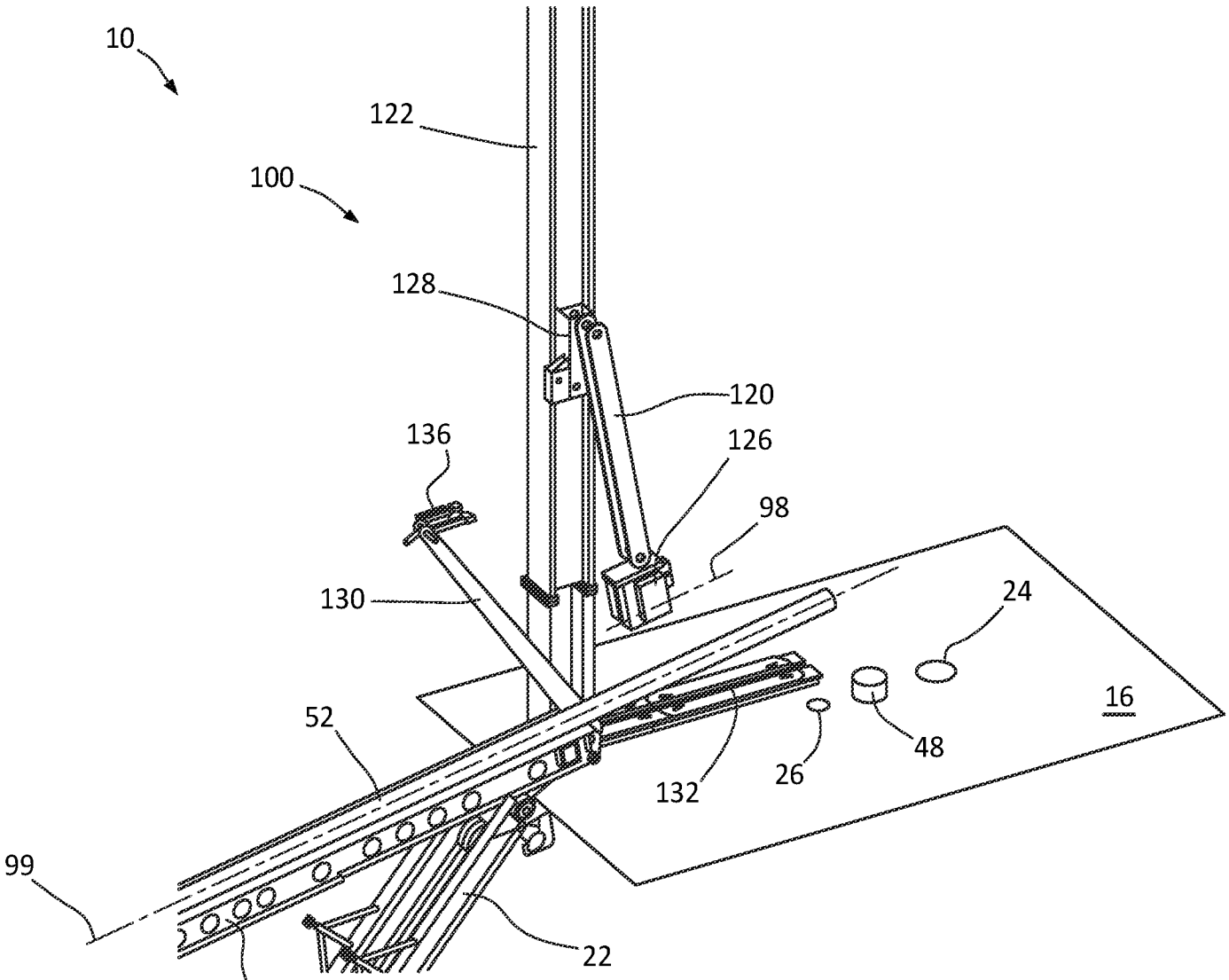

In FIG. 8B, the hoist 124 has lowered the base 128, thereby lowering the hoisting arm 120 closer to the desired engagement position, while the catwalk 20 has extended the tubular 52 the desired distance to allow the hoisting arm 120 to engage it at the desired position along the tubular 52. The gripper 126 can be been rotated to align a center axis 98 of the gripper 126 to be generally in parallel with the center axis 99 of the tubular 52.

Figure 8C:
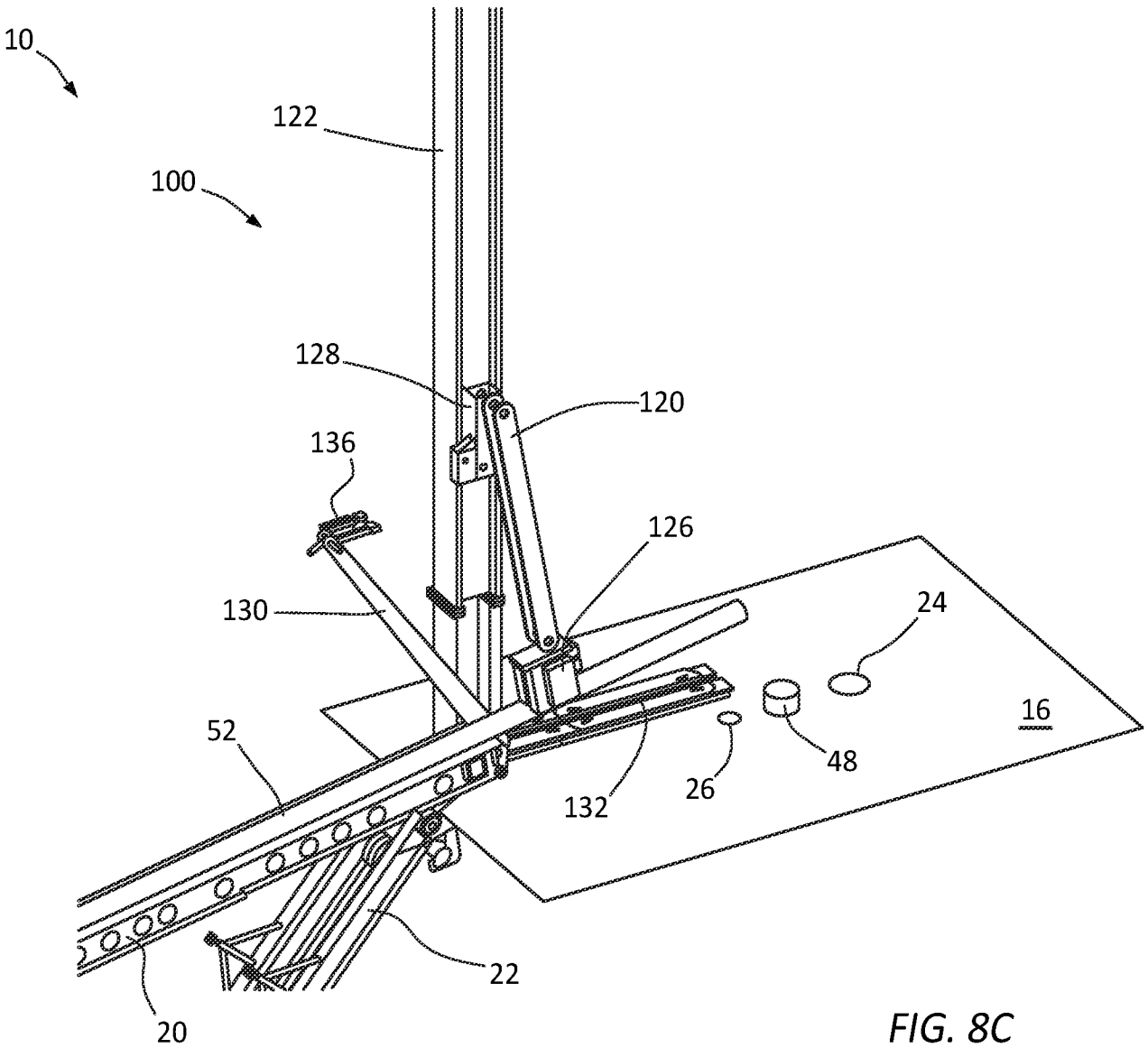

In FIG. 8C, the hoisting arm 120 can be lowered further to engage the tubular 52 at a desired location along the tubular 52. After engagement with the tubular 52, the hoisting arm 120 can be lifted, via the hoist 124 to begin removing the tubular 52 from the catwalk 20.

Figure 8D:
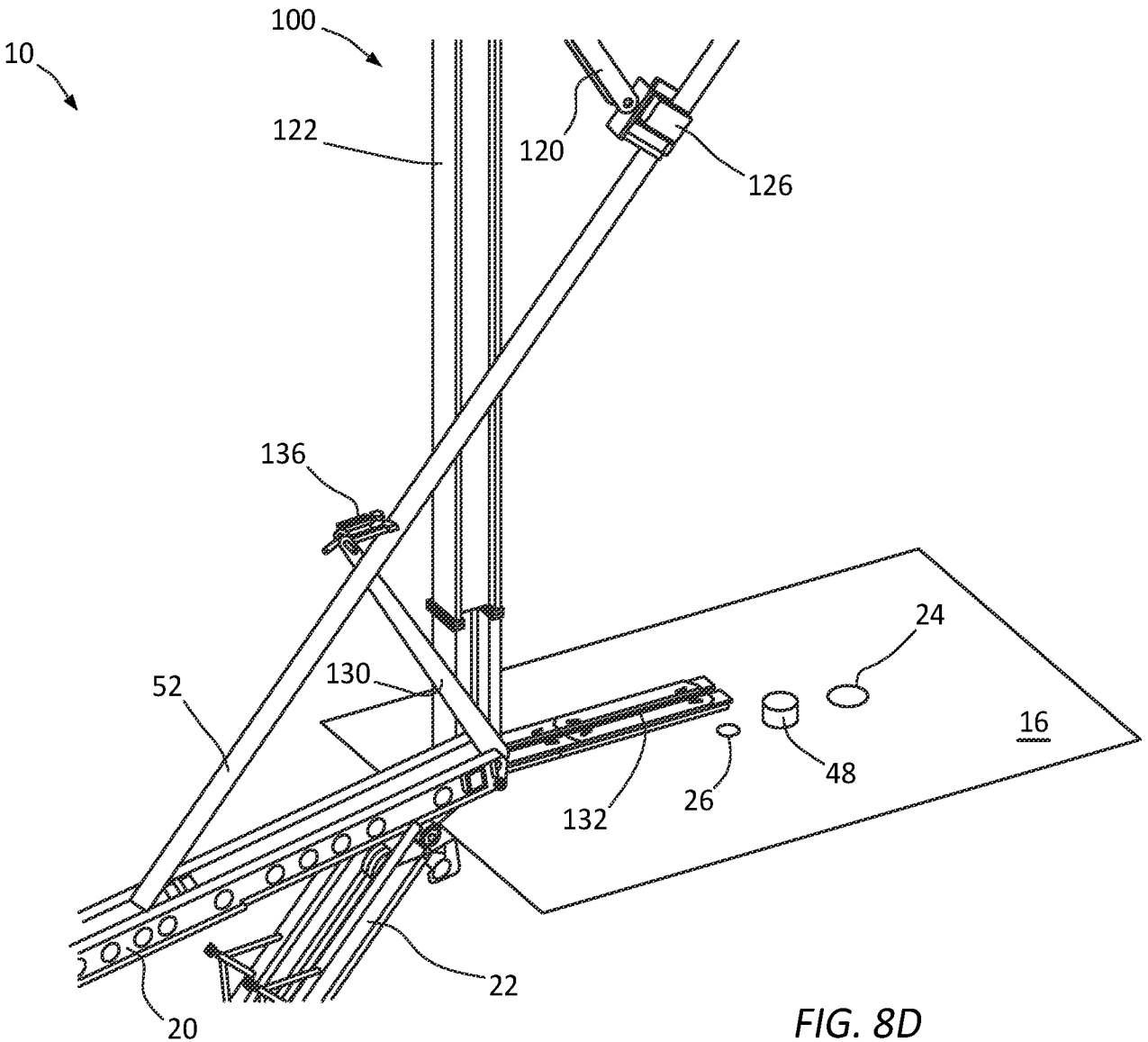

In FIG. 8D, the hoisting arm 120 can be raised while engaging the tubular 52, thereby lifting one end of the tubular 52 from the catwalk 20, while the other end of the tubular 52 slides along the catwalk 20 while the tubular 52 is being raised. As can be seen, the gripper 136 of the lower tailing arm 130 is still clear of the tubular 52 and not yet engaging with the tubular 52. As the tubular 52 is lifted by the hoisting arm 120, the hoisting arm 120 and the gripper 126 rotate as needed to transition the tubular 52 from the orientation on the catwalk 20 to a vertical orientation.

Figure 8E:
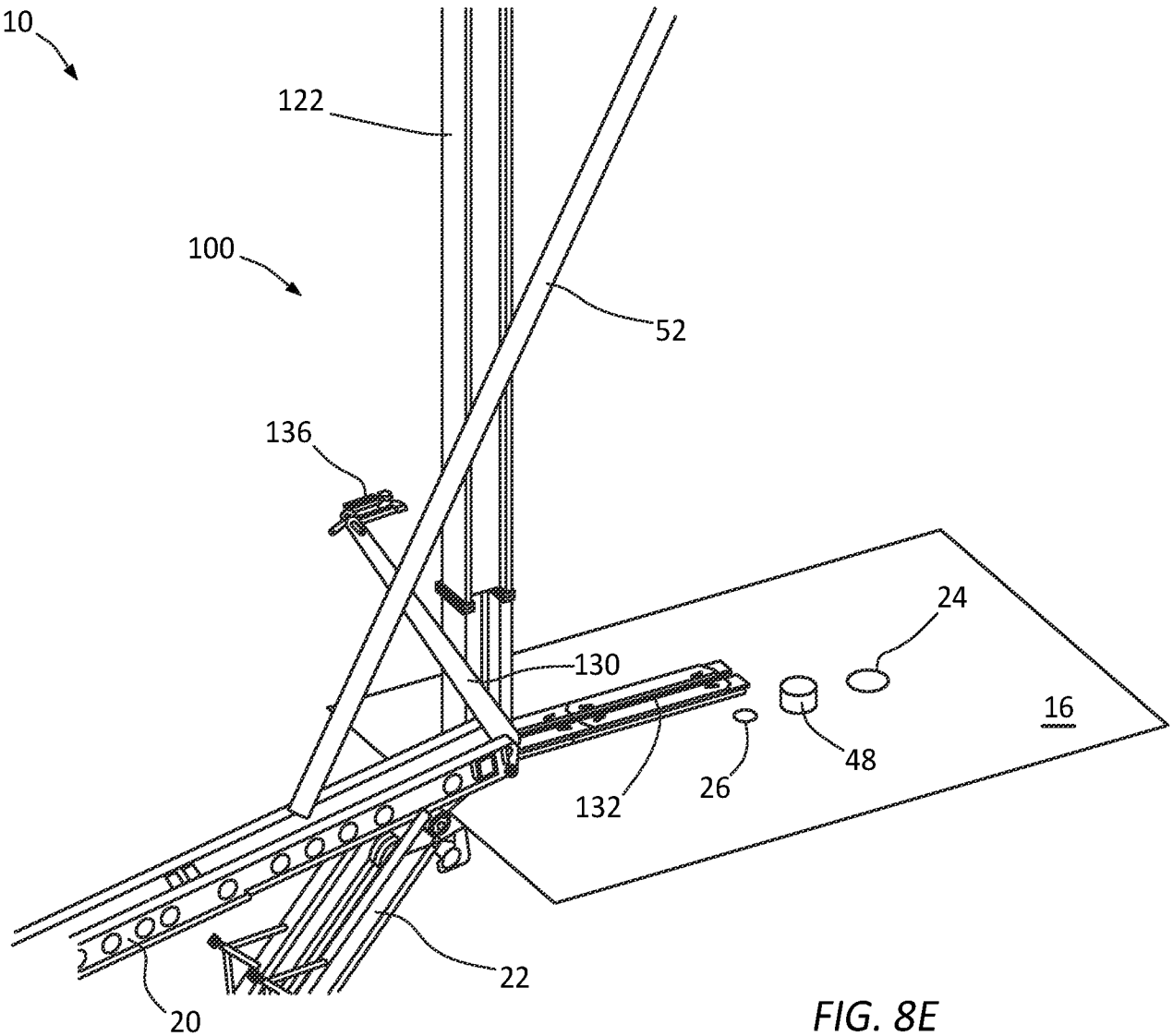

In FIG. 8E, the hoisting arm 120 can be raised higher, such that the lower end of the tubular 52 is reaching the end of the catwalk 20 and will soon swing from the end of the catwalk 20 toward the well center 24. The lower tailing arm 130 can be used to control this movement of the lower end of the tubular 52 from the catwalk 20 toward the well center 24 by engaging the lower end of the tubular 52 before it leaves the catwalk 20.

Figure 8F:
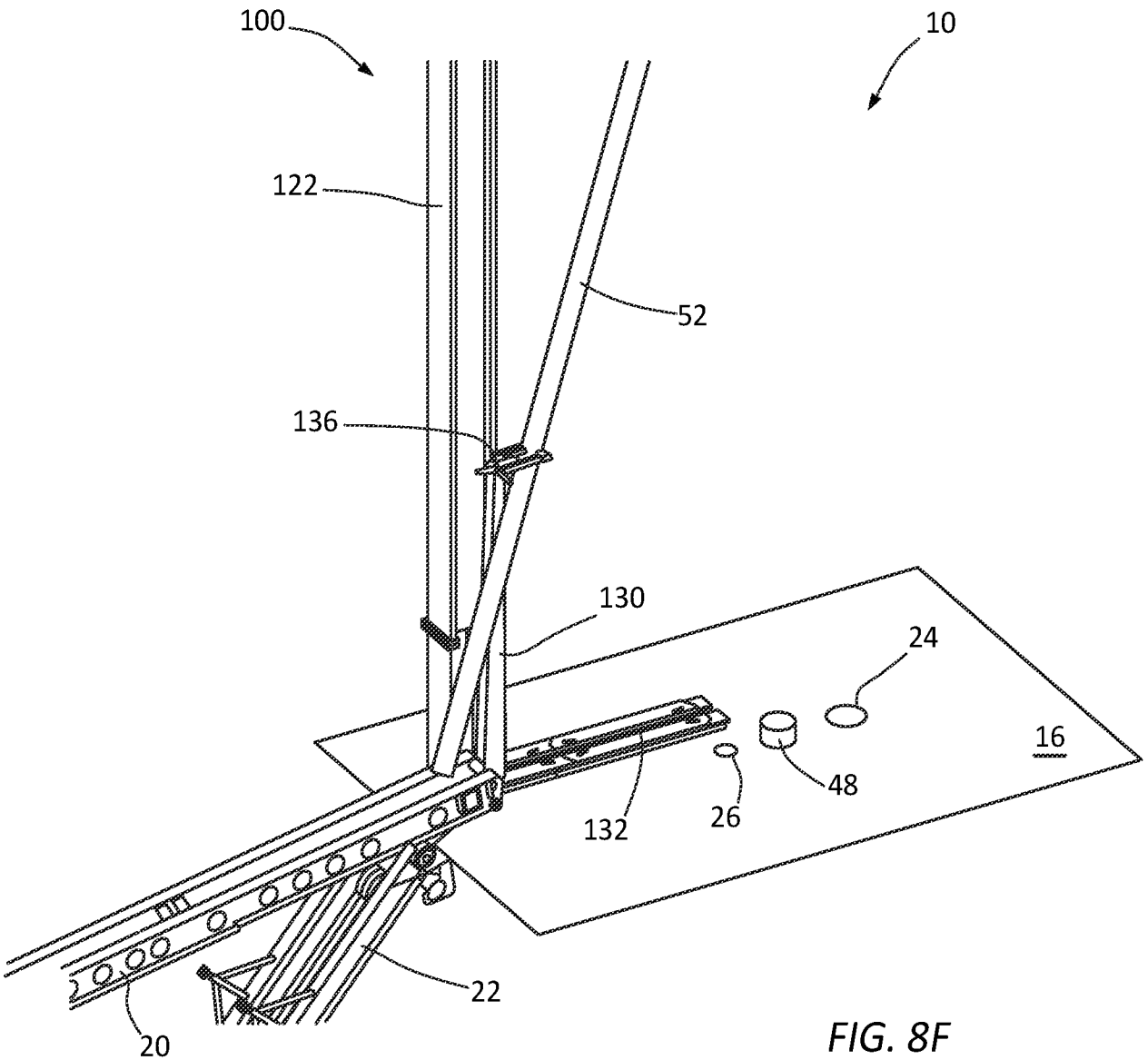

In FIG. 8F, the hoisting arm 120 can be raised even higher, such that the lower end of the tubular 52 is about to leave the end of the catwalk 20. The lower tailing arm 130 has been rotated toward the tubular 52 to allow the gripper 136 to engage the tubular 52. The engagement of the tubular 52 with the gripper 136 can allow vertical movement of the tubular 52 while controlling horizontal movement of the lower end of the tubular 52. In cooperation with each other, the hoisting arm 120 and the lower tailing arm 130 can manipulate the tubular 52 into a desired vertical orientation. However, it should be understood that the hoisting arm 120 and the lower tailing arm 130 can manipulate the tubular 52 into any number of desired orientations other than the vertical orientation.

Figure 8G:
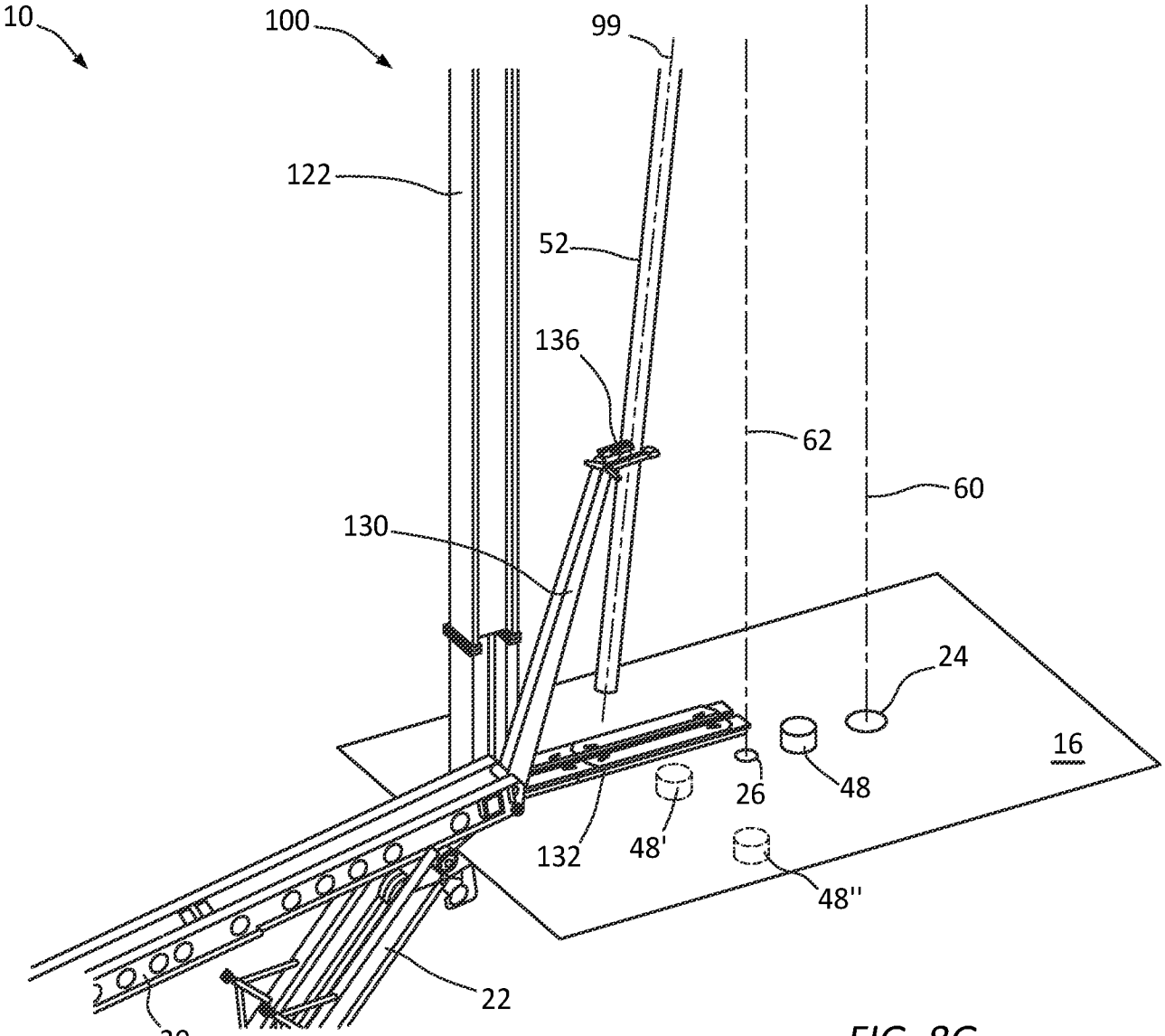

In FIG. 8G, the hoisting arm 120 can be raised even higher, such that the lower end of the tubular 52 is lifted off of the catwalk 20. With the gripper 136 of the lower tailing arm 130 engaged with the lower end of the tubular 52, the horizontal movement of the lower end of the tubular 52 toward the well center 24 is controlled to prevent uncontrolled swinging of the tubular 52. The center axis 99 of the tubular 52 is shown in an inclined orientation as the tubular 52 is being transitioned from the position on the catwalk 20 to a vertical orientation that can be generally parallel with the center axis 62 of the mousehole 26 or the center axis of the well center 24.

Figure 8H:
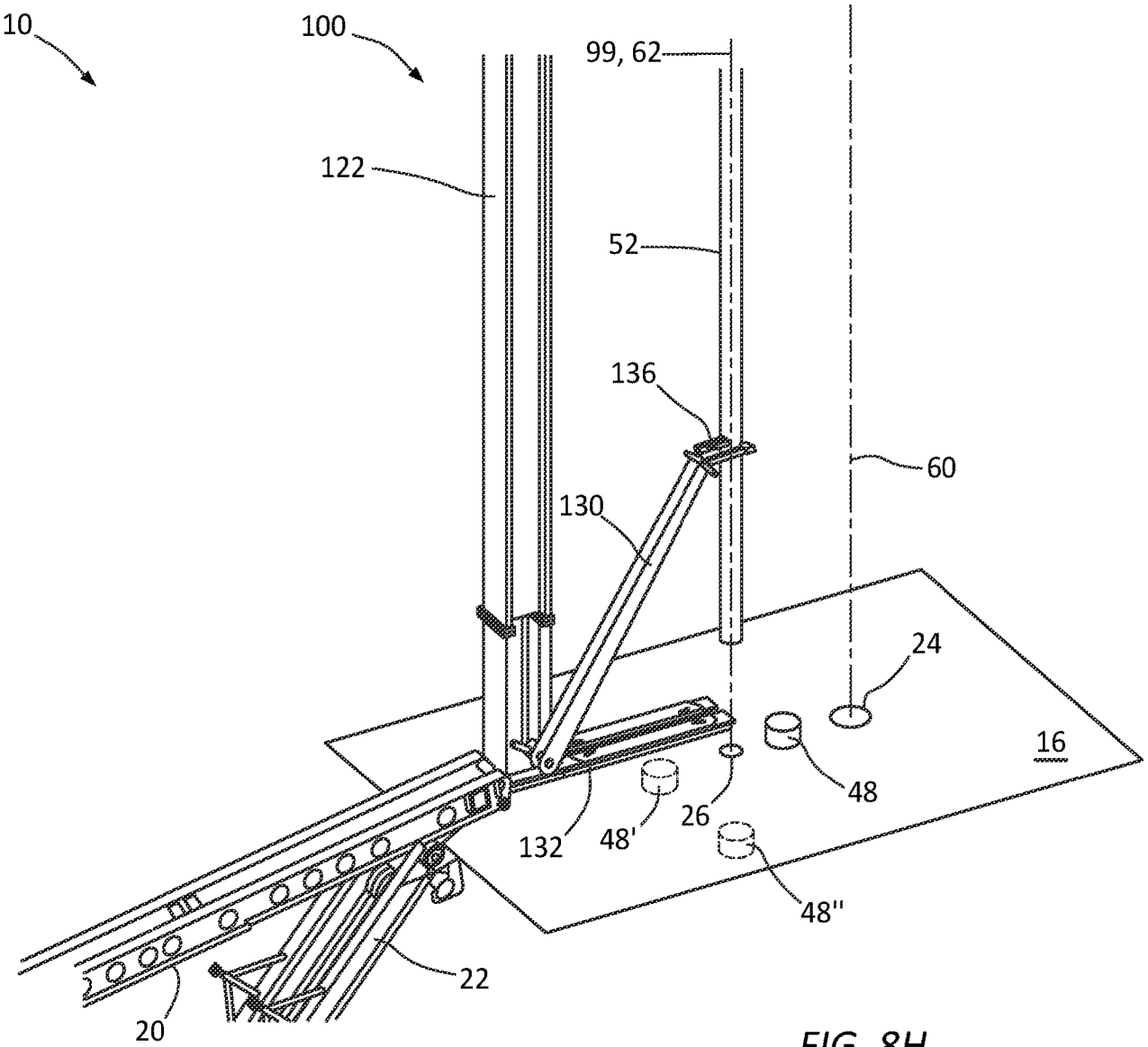

In FIG. 8H, the hoisting arm 120 and the lower tailing arm 130 can manipulate the tubular 52 into a desired vertical orientation, and the vertical support 122 can be moved horizontally to align the center axis 99 of the tubular 52 with the center axis 62 of the mousehole 26. At this position, the pipe handler 100 can lower the tubular 52 vertically downward into the mousehole 26 (or at least on to a stump of a tubular stand in the mousehole 26) by lowering the hoisting arm 120. The gripper 136 of the lower tailing arm 130 can allow vertical movement, so it can act like a tubular guide for aligning the tubular 52 with the mousehole 26. However, the pipe handler 100 can also move the tubular 52 to align with the well center 24, or the doping device 48. It should be understood that the doping device 48 can be at any number of locations on the rig floor 16 (such as is illustrated by the other positions 48', 48") or in the horizontal storage area 70, on the catwalk 20, etc.

Figure 8I:
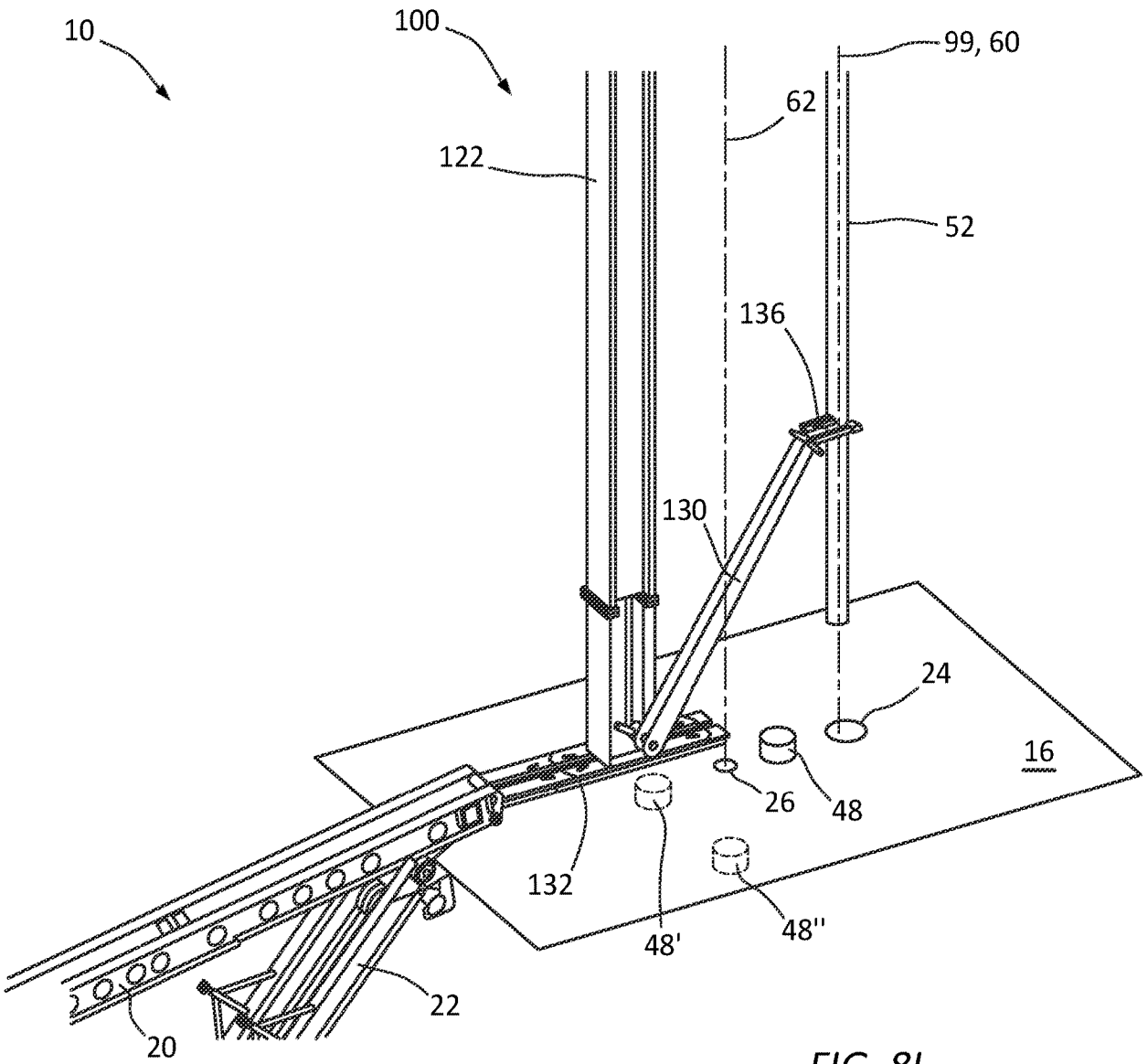

In FIG. 8I, the hoisting arm 120 and the lower tailing arm 130 can manipulate the tubular 52 into the desired vertical orientation, and the vertical support 122 can be moved horizontally to align the center axis 99 of the tubular 52 with the center axis 60 of the well center 24. At this position, the pipe handler 100 can lower the tubular 52 vertically downward into the well center 24 (or at least on to a stump of a tubular string 58 in the wellbore 15 at the well center 24) by lowering the hoisting arm 120. The gripper 136 of the lower tailing arm 130 can allow vertical movement, so it can act as a tubular guide for aligning the tubular 52 with the well center 24.

Figure 8J:
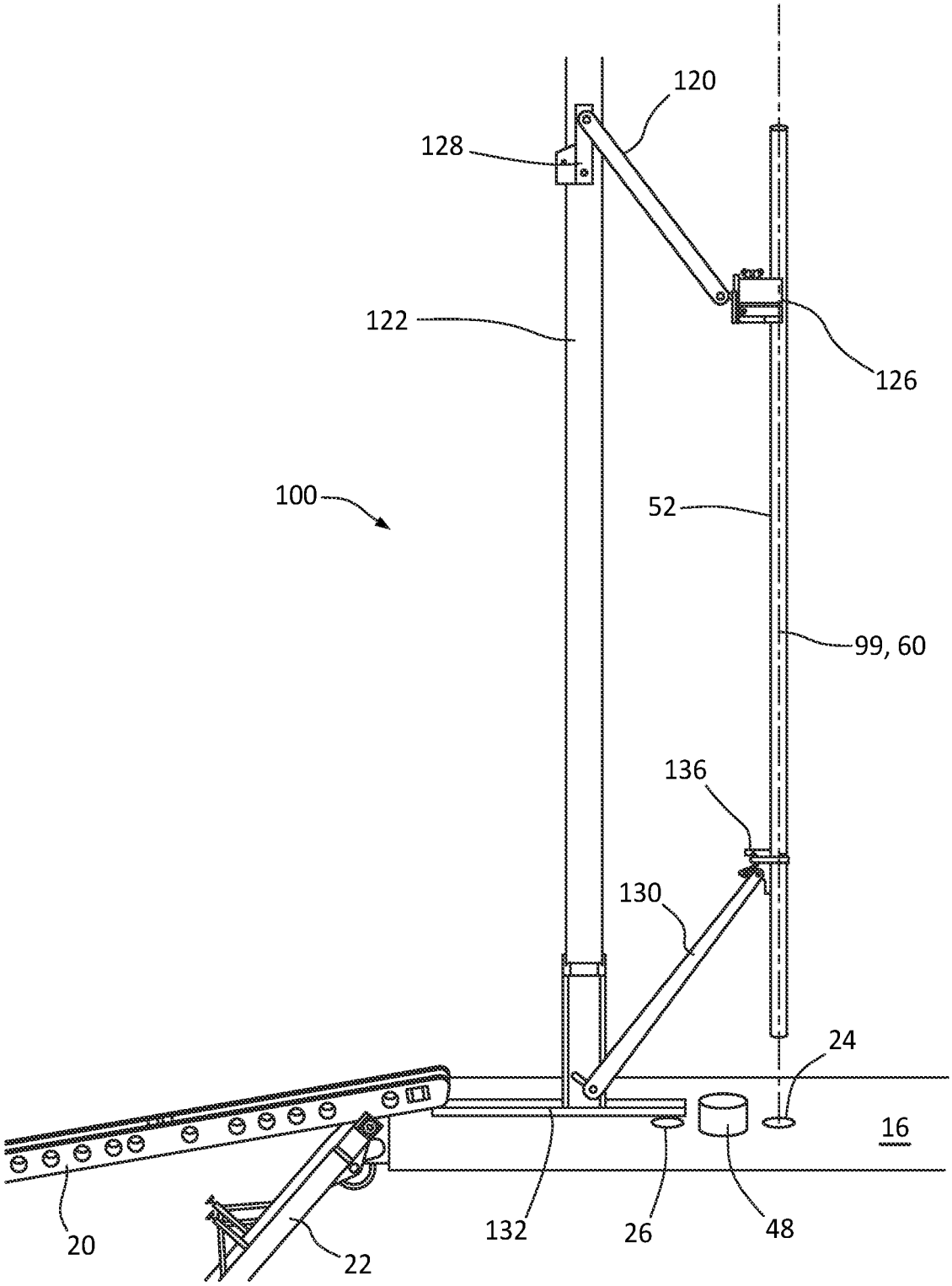

In FIG. 8J the hoisting arm 120 and the lower tailing arm 130 can manipulate the tubular 52 into the desired vertical orientation, and the vertical support 122 can be moved horizontally to align the center axis 99 of the tubular 52 with the center axis 60 of the well center 24. The hoisting arm 120 with its gripper 126 and the upper tailing arm 110 with its gripper 136 are shown in a desired orientation to hold the tubular 52 in the vertical orientation above the well center 24. To lower the tubular 52, the base 128 can be lowered with the hoisting arm 120 and the gripper 126 remaining in the desired positions, while the lower tailing arm 130 and its gripper 136 remain in the desired positions. The gripper 126 and the hoisting arm 120 are carrying the entire weight of the tubular 52, so that when the base 128 is lowered, the tubular 52 will be lowered along with the gripper 126, with the gripper 136 of the lower tailing arm 130 providing guidance of the tubular 52 as it is lowered.

It should be understood that the process illustrated by FIGS. 8A-8J show the pipe handler 100 retrieving a tubular 52 from the catwalk and transporting it to a location on the rig floor 16. However, these figures can also be used to understand the reverse process of transporting a tubular 52 from a location on the rig floor 16 to the catwalk 20 by reversing the operations described above.

Figure 9:
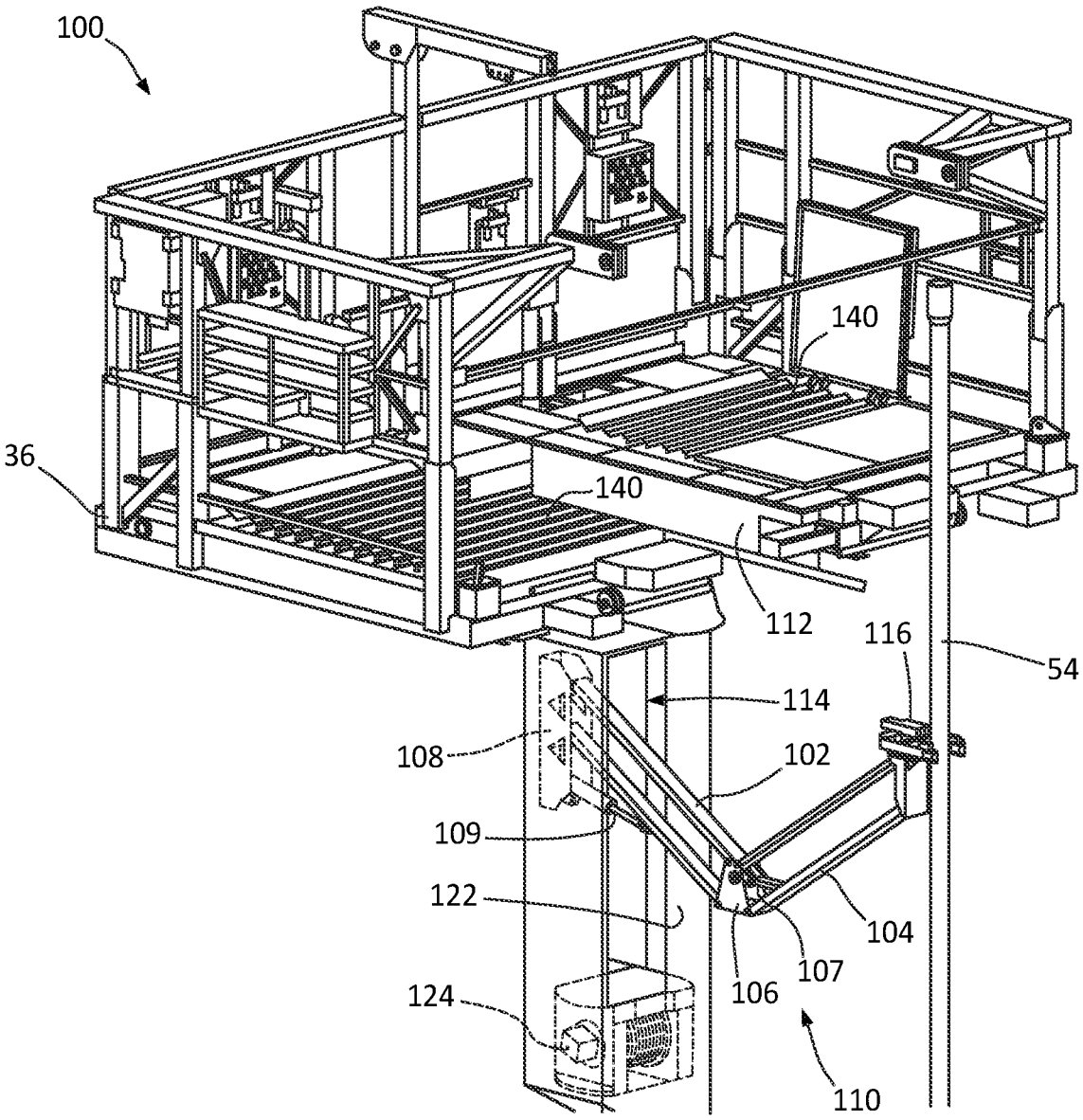
FIG. 9 is a representative perspective view of a fingerboard of a vertical storage area with a pipe handler for performing a subterranean operation coupled underneath, in accordance with certain embodiments.

FIG. 9 is a representative perspective view of a fingerboard 140 of a vertical storage area 36 with a pipe handler 100 for performing a subterranean operation coupled underneath, in accordance with certain embodiments. As can be seen, the upper end of the vertical support 122 can be moveably coupled to the upper track 112. As described above, the upper track 112 can be offset from the center line 90 of the catwalk 20. There is a horizontal space between the upper track 112 and the fingers of the fingerboard 140 to allow access of the pipe handler 100 to move tubulars 54 into or out of the fingers.

The upper tailing arm 110 is shown fixedly attached to the vertical support 122 in a cavity 114 via the base 108. The upper tailing arm 110 can include two sets of parallel segments 102, 104, which can be rotationally coupled to each other by a coupling 106. One end of the segment set 102 can be rotationally coupled to the base 108, such that an actuator 109 can cause the segment set 102 to rotate outward from or inward into the cavity 114. The other end of the segment set 102 can be rotationally coupled to the coupling 106, such that the base 108, the coupling 106, and the segment set 102 can form a parallelogram.

One end of the segment set 104 can be rotationally coupled to the coupling 106, such that an actuator 107 can cause the segment set 104 to rotate relative to the coupling 106. The other end of the segment set 104 can be rotationally coupled to the gripper 116, such that the coupling 106, the gripper 116, and the segment set 104 can form a parallelogram. Thereby, actuating the actuator 109 can cause the upper tailing arm 110 to retract into the cavity 114 or extend from the cavity 114, while maintaining a desired orientation of the gripper 116 at any position of the gripper 116 between fully extended or fully retracted toward the cavity 114.

It should be understood that the actuator 107 can be a mechanical actuator, such as a mechanical linkage that rotates along with the segment set 102 and causes the segment set 104 to rotate in an opposite direction relative to the coupling 106.

Figure 10A:
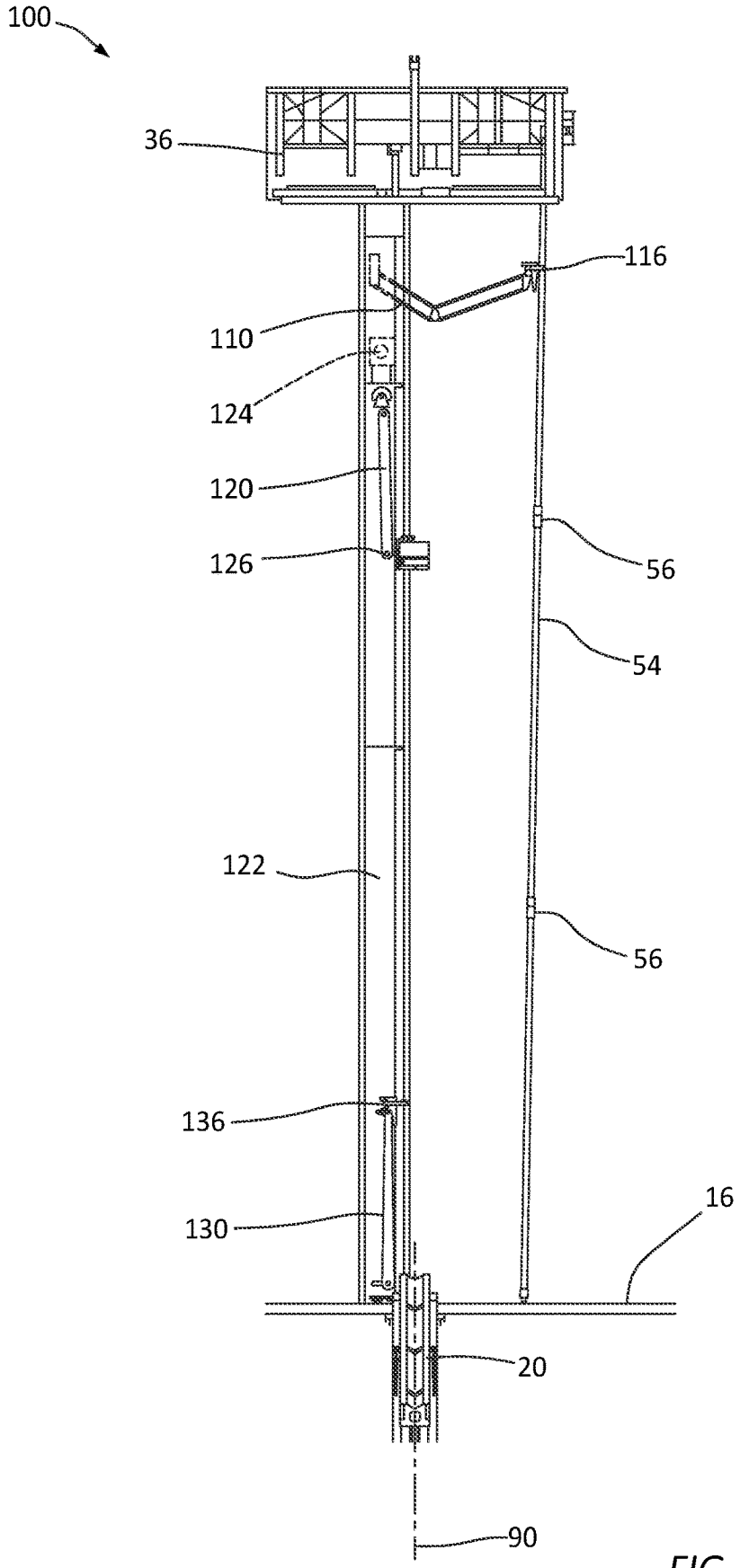
FIGS. 10A-10E are representative side views of a pipe handler retrieving a tubular (e.g., a tubular stand) from a vertical storage area and transporting the tubular to well center, in accordance with certain embodiments.
Figure 10B:
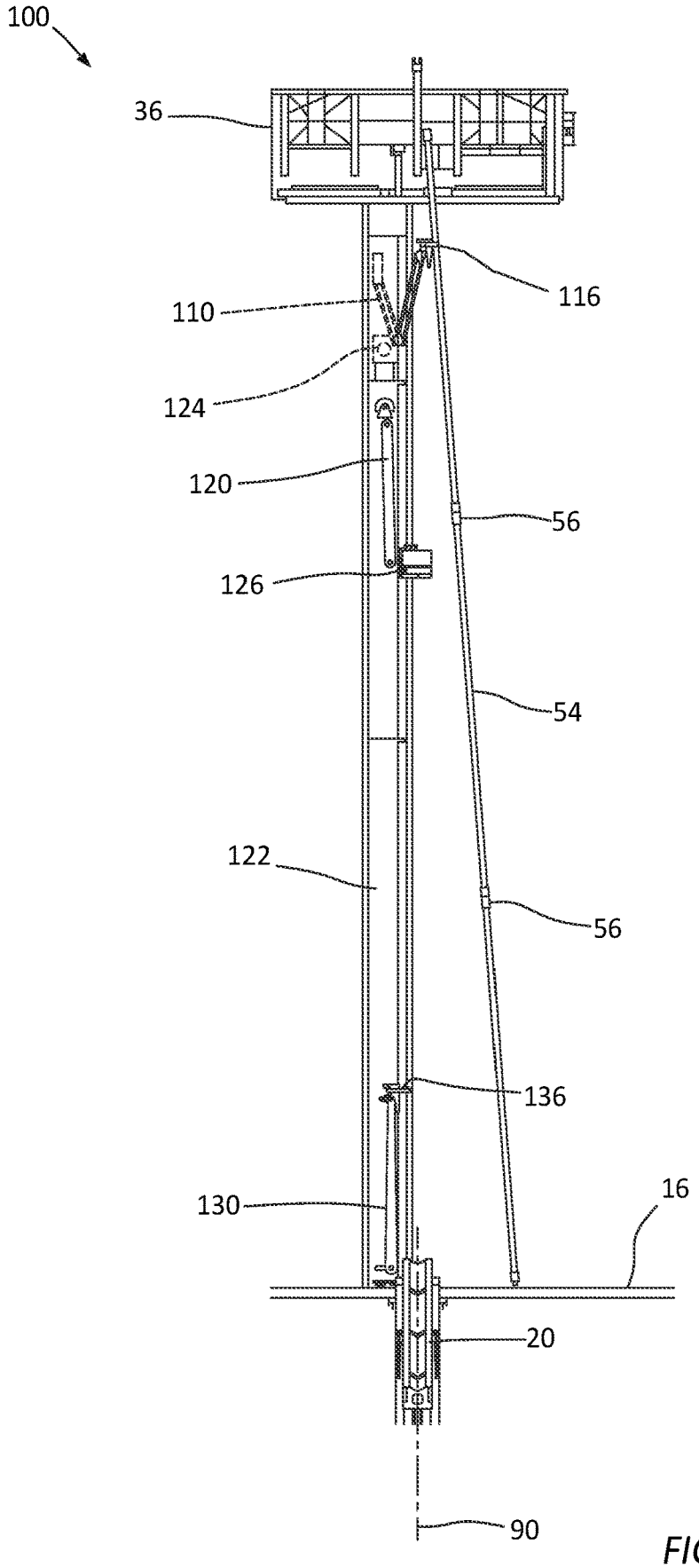
Figure 10C:
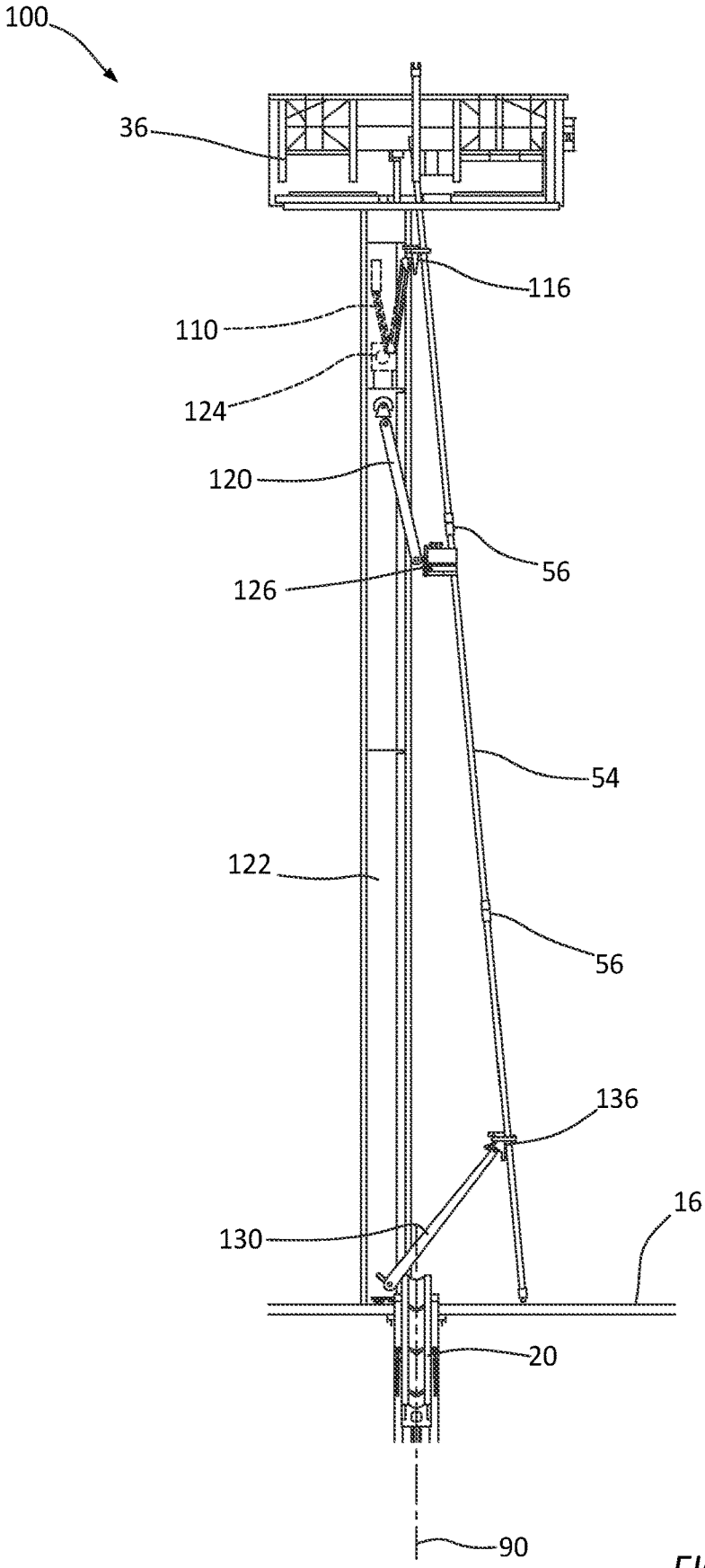
Figure 10D:
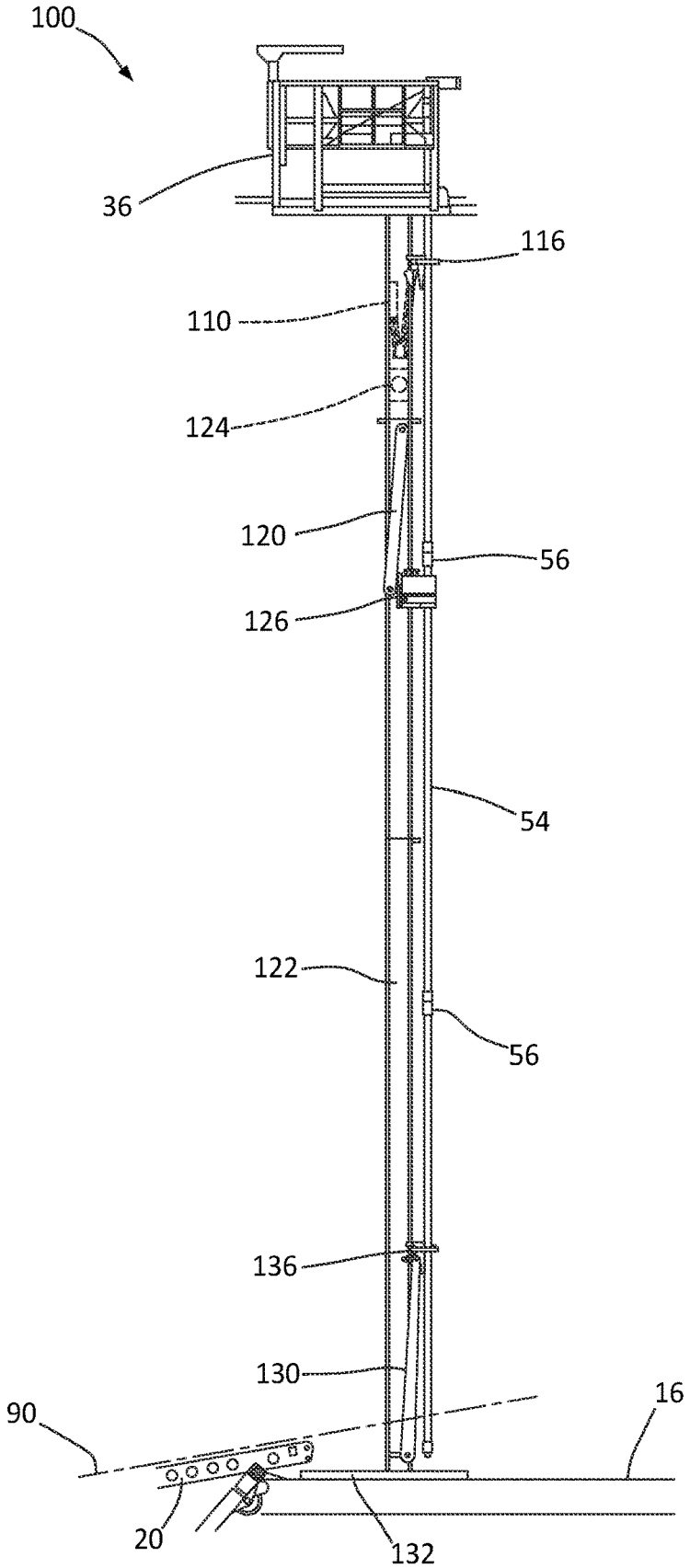
Figure 10E:
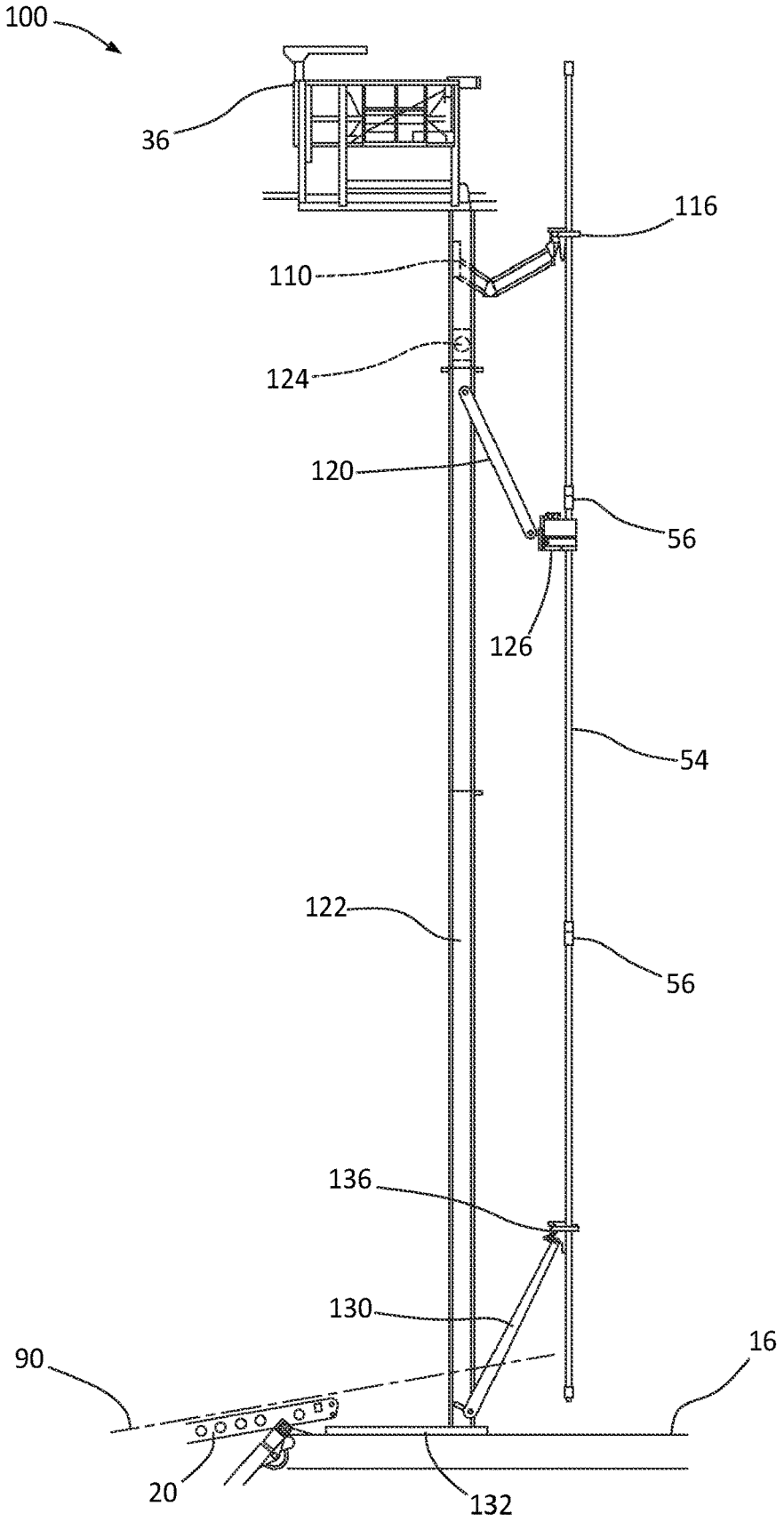

FIGS. 10A-10E are representative side views of a pipe handler 100 retrieving a tubular 54 (e.g., a tubular stand) from a vertical storage area 36 and transporting the tubular 54 to well center 24, in accordance with certain embodiments. FIGS. 10A-10C are shown as side views of the rig 10 that are perpendicular to the center line 90 of the catwalk 20 and FIGS. 10D-10E are shown as side views of the rig 10 that are parallel to the center line 90 of the catwalk 20, to illustrate interaction of the pipe handler 100 with a tubular 54 in the vertical storage area 36.

In FIG. 10A, the upper tailing arm 110 can be extended to engage, via the gripper 116, a tubular 54 being stored in an outside location in the vertical storage area 36. The pipe handler 100 can access any location in the vertical storage area 36. This example is merely chosen to aid in describing the operation of the pipe handler 100. The tubular 54 is shown as being tilted in the vertical storage area 36, which can sometimes be preferred. However, the tubular 54 can be at any angle in the vertical storage area 36 that allows it to be supported by the structures of the vertical storage area 36.

In FIG. 10B, the upper tailing arm 110 can be retracted, such that the upper end of the tubular 54 is moved close to the vertical support 122, thereby pivoting the tubular 54 about the lower end of the tubular 54 that can be resting on a portion of the rig floor 16. By allowing the upper tailing arm 110 to retrieve the upper end of the tubular 54 from the location in the vertical storage area 36 and move it close to the vertical support 122, the vertical storage area 36 can be designed to store tubulars 54 that are positioned out of reach of the hoisting arm 120. This allows the vertical storage area 36 to designed to be larger or the hoisting arm 120 to be designed to be shorter or both.

The hoisting arm 120 can be shorter than if it had to reach all tubulars 54 stored in the vertical storage area 36. Since the hoisting arm 120 is designed to hold the entire weight of the tubular 54, by not requiring it to reach the farthest location in the vertical storage area 36 from the pipe handler 100, it can be reduced in size, thereby reducing required weight and required forces to be managed during operation. Therefore, since the upper tailing arm 110 moves the upper end of the tubular 54 closer to the pipe handler 100, the hoisting arm 120 can grab it closer to the vertical support 122, thereby allowing a shorter hoisting arm 120 to lift the entire weight of the tubular 54, reducing the moment arm required to hold the tubular 54.

In FIG. 10C, the hoisting arm 120 and the lower tailing arm 130 can be extended to engage the tubular 54 with the grippers 126, 136, respectively. The hoisting arm 120 can lift the tubular 54 from the support on the rig floor 16 and the arms 110, 120, 130 can cooperate with each other to retract the tubular 54 from the vertical storage area 36 to a vertical orientation near the vertical support 122.

In FIG. 10D, the pipe handler 100 has rotated approximately 90 degrees from the position in FIG. 10C with the tubular 54 in a vertical orientation near the vertical support 122 to minimize clearance needed to rotate the pipe handler 100. With pipe handler 100 rotated, the pipe handler 100 is in position to present the tubular 54 to the well center, or the mousehole 26, or the doping device 48 or the catwalk 20.

In FIG. 10E, the pipe handler 100 has moved horizontally along the upper track 112 and the lower track 132 toward the well center 24 and the arms 110, 120, 130 have been extended as needed to present the tubular 54 at the well center 24 in a vertical orientation.

It should be understood that these figures can also be used to illustrate moving a tubular 54 from the well center 24, or the mousehole 26, or the doping device 48 or the catwalk 20, to a location in the vertical storage area 36 by reversing the operations described above regarding FIGS. 10A-10E.

Figure 11:
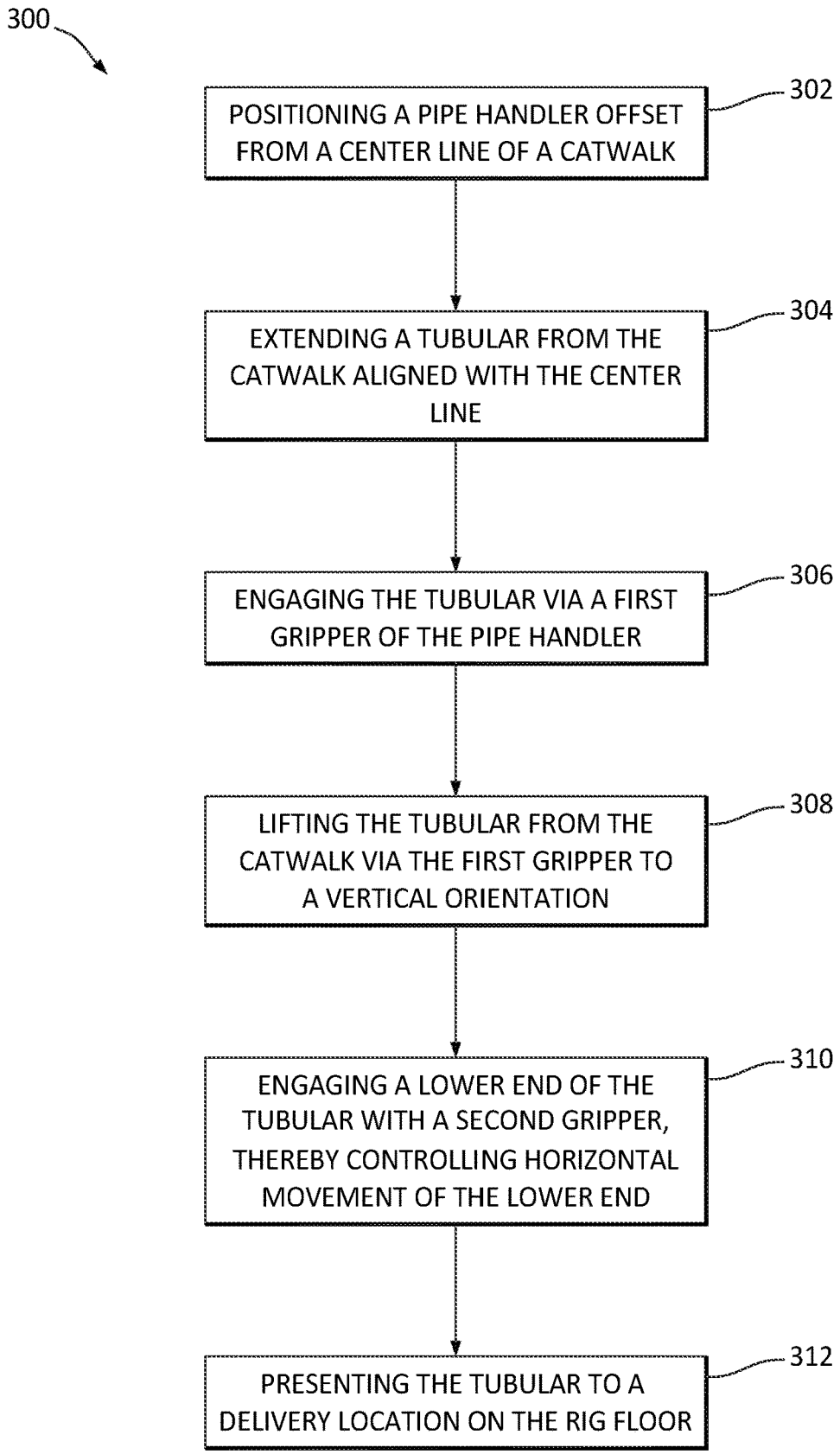
FIG. 11 is a representative flow diagram of a method 300 for handling tubulars in a subterranean operation, in accordance with certain embodiments.

FIG. 11 is a representative flow diagram of a method 300 for handling tubulars in a subterranean operation, in accordance with certain embodiments. The method 300 can include at operation 302 to position a pipe handler 100 on a rig floor and offset from a center line of a catwalk. The pipe handler 100 can be coupled to a lower track 132 on the rig floor 16 and an upper track 112 underneath a fingerboard 140 of the vertical storage area 36, where a vertical support 122 of the pipe handler 100 is positioned between them and movably coupled to them. The upper and lower tracks 112, 132 allow the pipe handler 100 to move horizontally between the catwalk 20 and the well center 24, but both are offset from the center line 90 of the catwalk 20, such that a tubular 52 can be extended from the catwalk 20 over a portion of the rig floor and beside a vertical support 122 of the pipe handler 100.

In operation 304, the tubular 52 can be extended from the catwalk 20 in line with the center line 90 and positioned beside the vertical support 122 of the pipe handler 100. In operation 306, the hoisting arm 120 of the pipe handler 100 can engage the tubular 52 via a gripper 126. In operation 308 the gripper 126 can lift the tubular 52 from the catwalk 20, while in operation 310 a lower end of the tubular 52 can be engaged by a gripper 136 of the lower tailing arm 130 to control horizontal movement of the lower end as the tubular 52 is being lifted by the gripper 126 to a vertical orientation.

In operation 312 the pipe handler 100 can deliver the tubular 52 to a deliver location on the rig floor 16. The deliver location for receiving a tubular 52 from the catwalk 20 can be any one of the doping device 48, the mousehole 26, the well center 24, the vertical storage area 36, or the top drive 18, with the pickup location being the catwalk 20. For delivering the tubular 52 to the catwalk 20, a pickup location can be the doping device 48, the mousehole 26, the well center 24, the vertical storage area 36, or the top drive 18, with the destination location being the catwalk 20. It should be understood that any of the doping device 48, the mousehole 26, the well center 24, the vertical storage area 36, the top drive 18, or the catwalk 20 can be either a pickup location or a delivery location depending upon the operation being performed by the pipe handler 100.

Figure 12:
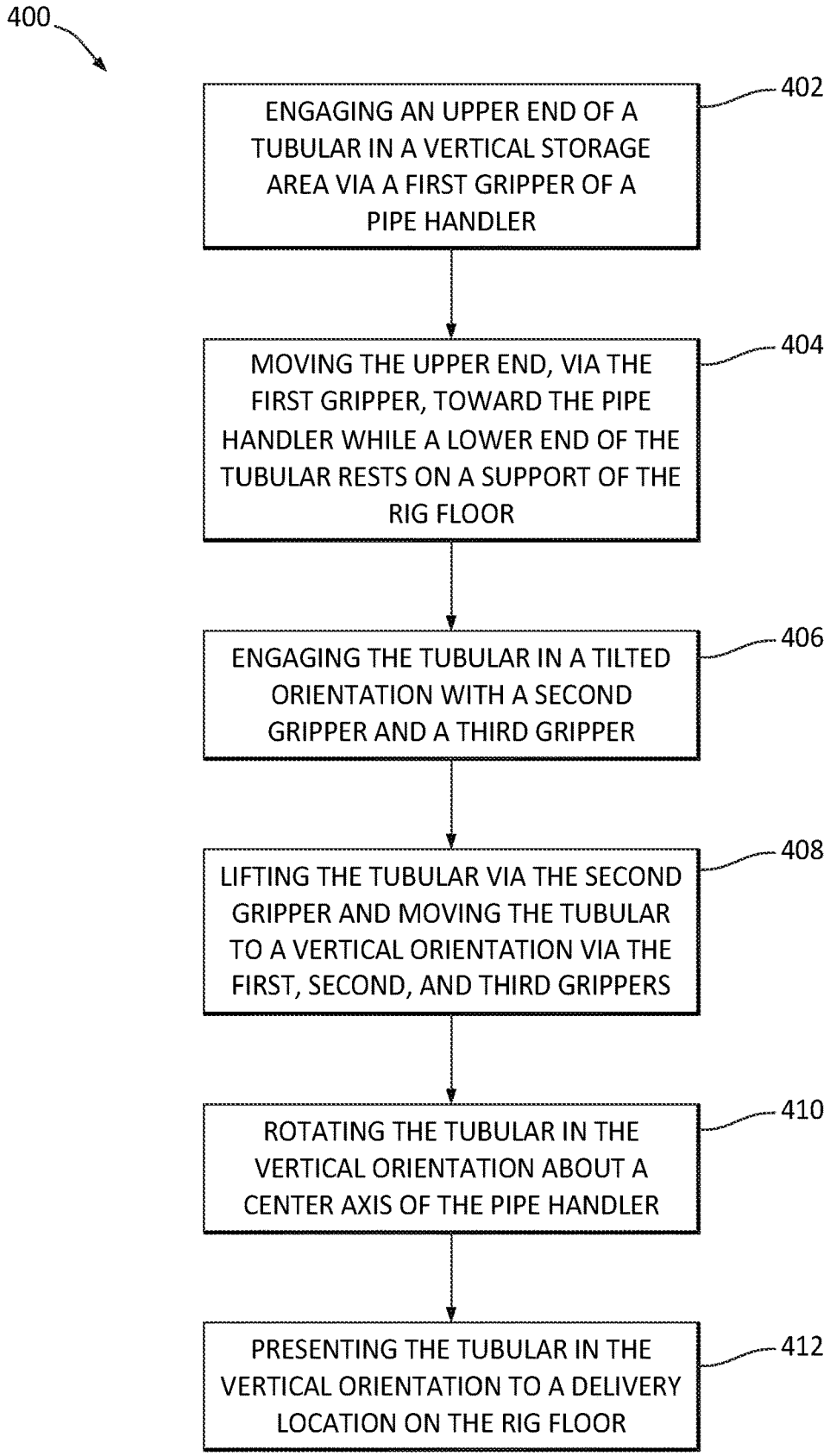
FIG. 12 is a representative flow diagram of a method 400 for handling tubulars in a subterranean operation, in accordance with certain embodiments.

FIG. 12 is a representative flow diagram of a method 400 for handling a tubular 54 in a subterranean operation, in accordance with certain embodiments. In operation 402, the upper tailing arm 110 can be extended to engage an upper end (or upper portion) of a tubular 54 in a vertical storage area 36 via a gripper 116. In operation 404, the gripper 136 can move the upper end toward the pipe handler 100, while the lower end remains resting on a support in the vertical storage area 36 on the rig floor 16. This may cause the tubular 54 to be tilted toward the pipe handler 100, with the bottom end further away from the pipe handler 100 than the upper end.

In operation 406, the gripper 126 of the hoisting arm 120 can engage the tubular 54 in preparation for lifting the tubular 54, and the lower tailing arm 130 an engage the lower end (or lower portion) of the tubular 54. In operation 408, the gripper 126 can lift the tubular 54 to take the weight of the tubular 54 off of the support on the rig floor 16, allowing the arms 110, 120, 130 to tilt the tubular 54 to a generally vertical orientation and position the tubular 54 proximate the vertical support 122 of the pipe handler 100.

With the tubular 54 held close to the vertical support 122, in operation 410, if needed, the pipe handler 100 can rotate the tubular 54 as needed, while being held in the vertical orientation, about a center axis of the vertical support 122. In operation 412, with the pipe handler 100 rotated to the desired azimuthal orientation, then the arms 110, 120, 130 can extend the tubular 54 in a vertical orientation and align it with a delivery location, such as the doping device 48, the mousehole 26, the well center 24, another position in the vertical storage area 36, or the top drive 18.

Figure 13:
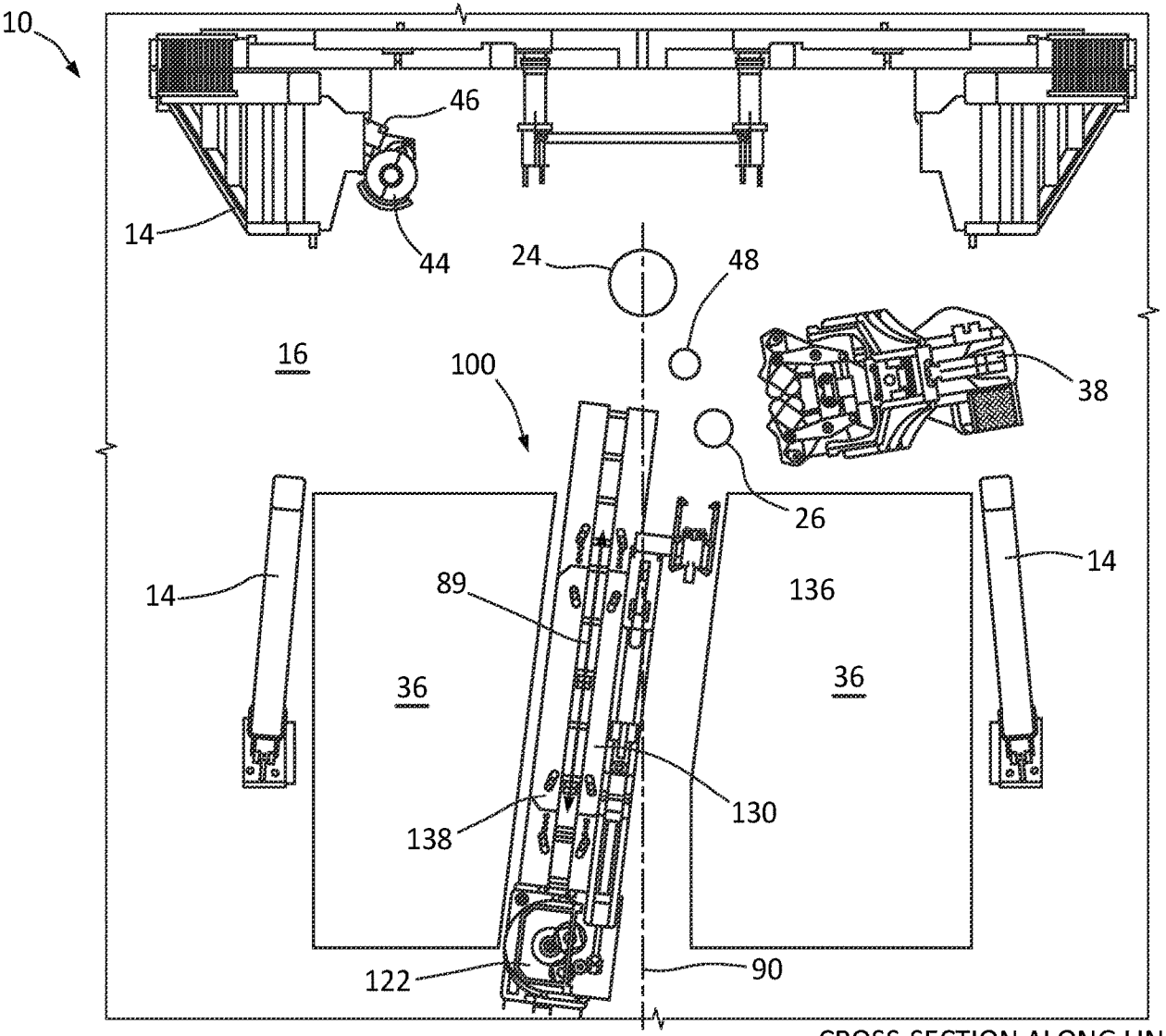
FIG. 13 is a representative partial cross-sectional view 5-5, as indicated in FIG. 4, of the rig with a pipe handler coupled to an angled track for performing a subterranean operation, in accordance with certain embodiments.

FIG. 13 is a representative partial cross-sectional view 5-5, as indicated in FIG. 4, of the rig 10 with a pipe handler 100 for performing a subterranean operation, in accordance with certain embodiments. The vertical support 122 can move (arrows 89) along the angled lower track 138 toward and away from the well center 24. The vertical support 122 can be coupled to an angled upper track 118, not shown, that is oriented parallel with the angled lower track 138 but it is positioned proximate the fingers of the fingerboard 140 of the vertical storage area 36. As can be seen, one end of the angled lower track 138 (and correspondingly, one end of the angled upper track 118) can be offset from the center line 90 of the catwalk 20, where the center line 90 is in line with the well center 24.

In a certain embodiment, the mousehole 26 and the doping device 48 (if used) can be offset from the center line 90. The arms 110, 120, 130 can be positioned on a side of the vertical support 122 to engage tubulars 54 that are aligned with the center line 90. The lower tailing arm 130 can be positioned such that the gripper 136 is above the tubular 52 that is extended from the catwalk 20. As can be seen, the pipe handler 100 can be moved to access any of the mousehole 26, doping device 48, the well center 24, tubular storage locations in the vertical storage area 36, a top drive 18, or an iron roughneck 38 by translating along the angled lower and upper tracks 138, 118, and rotating around a center axis 91 of the vertical support 122.

The iron roughneck 38 can be extended to makeup or breakup tubular joints 56 at the mousehole 26 or the well center 24. The mud bucket 44 can be extended, via the drill floor arm 46, to access a tubular joint 56 at well center 24, such as when the tubular string 58 is being tripped out of the wellbore 15. Both the mud bucket 44 and the iron roughneck 38 can be retracted to a stowed position when not needed.

Figure 14:
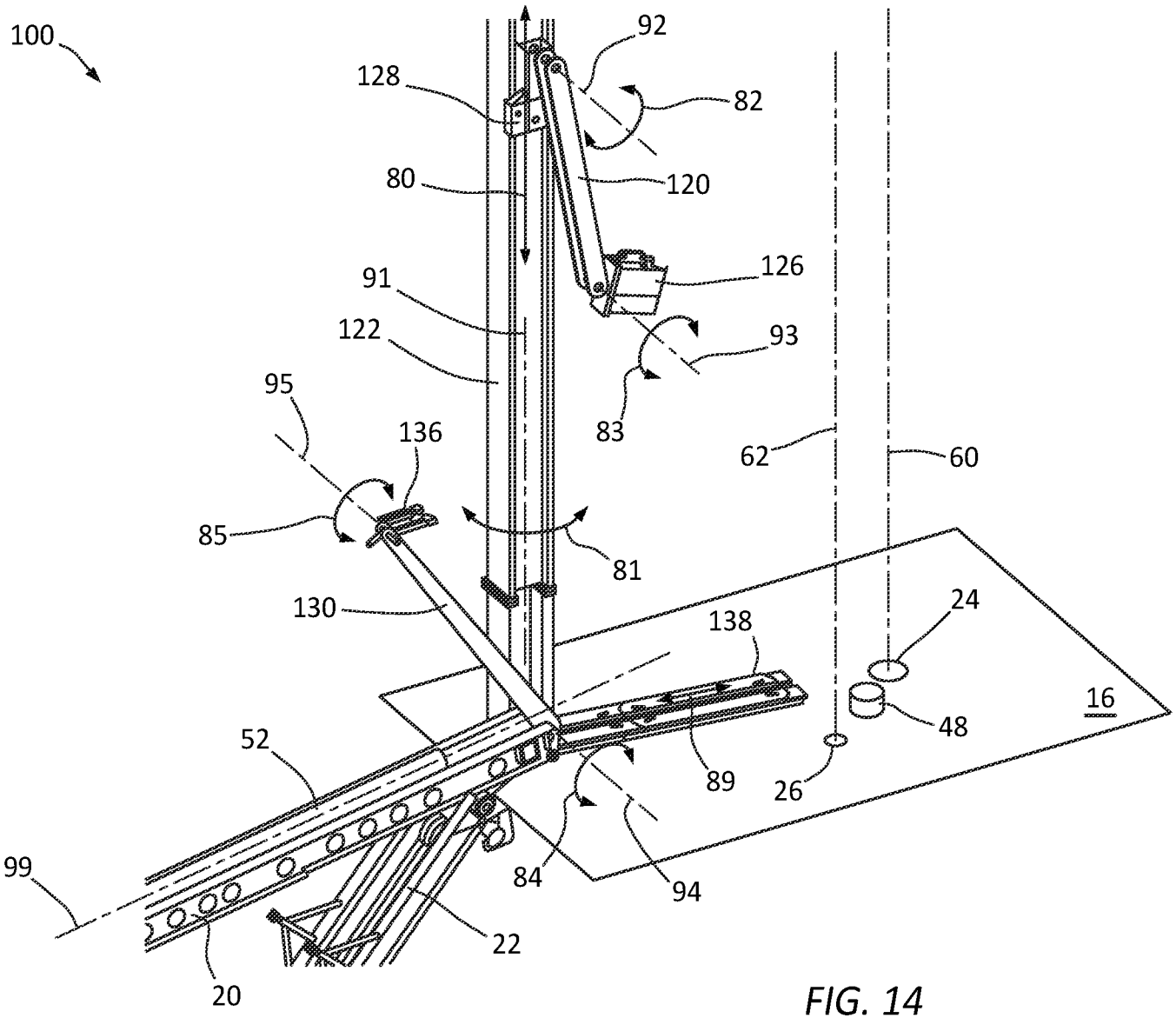
FIG. 14 is a representative perspective view of a pipe handler receiving a tubular from a catwalk and transporting the tubular along an angled track to a mousehole or well center, in accordance with certain embodiments.

FIG. 14 is a representative perspective view of a pipe handler 100 receiving a tubular 52 from a catwalk 20 and transporting the tubular 52 to a mousehole 26, doping device 48, or a well center 24, in accordance with certain embodiments. As mentioned above, the hoisting arm 120 can move vertically along the vertical support 122 via the hoist 124 raising or lowering the base 128 (arrows 80). The one end of the hoisting arm 120 can be rotationally coupled to the base 128 at the pivot axis 92 and can be rotated (arrows 82) about the pivot axis 92 via the actuator 123 (see FIG. 4). The opposite end of the hoisting arm 120 can be rotationally coupled to the gripper 126 at the pivot axis 93 and can be rotated (arrows 83) about the pivot axis 93 via the actuator 121 (see FIG. 4).

The vertical support 122 can be rotated (arrows 81) about the pivot axis 91 (or otherwise referred to as the center axis 91), thereby rotating the arms 110, 120, 130 about the pivot axis 91 as needed to manipulate a tubular about the rig floor 16 when one or more of the arms are engaged with the tubular. The vertical support 122 can be translated along the angled upper and lower tracks 118, 138 as needed to manipulate the tubular about the rig floor 16 when one or more of the arms are engaged with the tubular. For example, as described above in reference to FIGS. 8A-8J, the pipe handler 100 can be used to receive a tubular 52 from the catwalk 20 and present it to the mousehole 26, the doping device 48, the well center 24, or other delivery locations.

However, in certain embodiments, the angled upper and lower tracks 118, can allow the pipe handler 100 to be parked in a location on the tracks 118, 138 at one end closest to the catwalk 20, such that the pipe handler 100 allows clearance for other rig operations involving the catwalk 20. When the pipe handler 100 moves a tubular 52 from the catwalk 20 to a delivery location, such as well center 24, the vertical support may be rotated to align a vertically oriented tubular 52 with a center axis 62 of the mousehole 26, or a center axis 60 of the well center 24, or another delivery location (e.g., the doping device, top drive, etc.).

One end of the lower tailing arm 130 can be rotationally coupled to the lower end of the vertical support 122 at the pivot axis 94 and can be rotated (arrows 84) about the pivot axis 94 via an actuator (not shown). The lower tailing arm 130 has been positioned to receive the tubular 52 from the catwalk 20, and the hoisting arm 120 is being lowered to a position to engage the tubular 52.

Figure 15A:
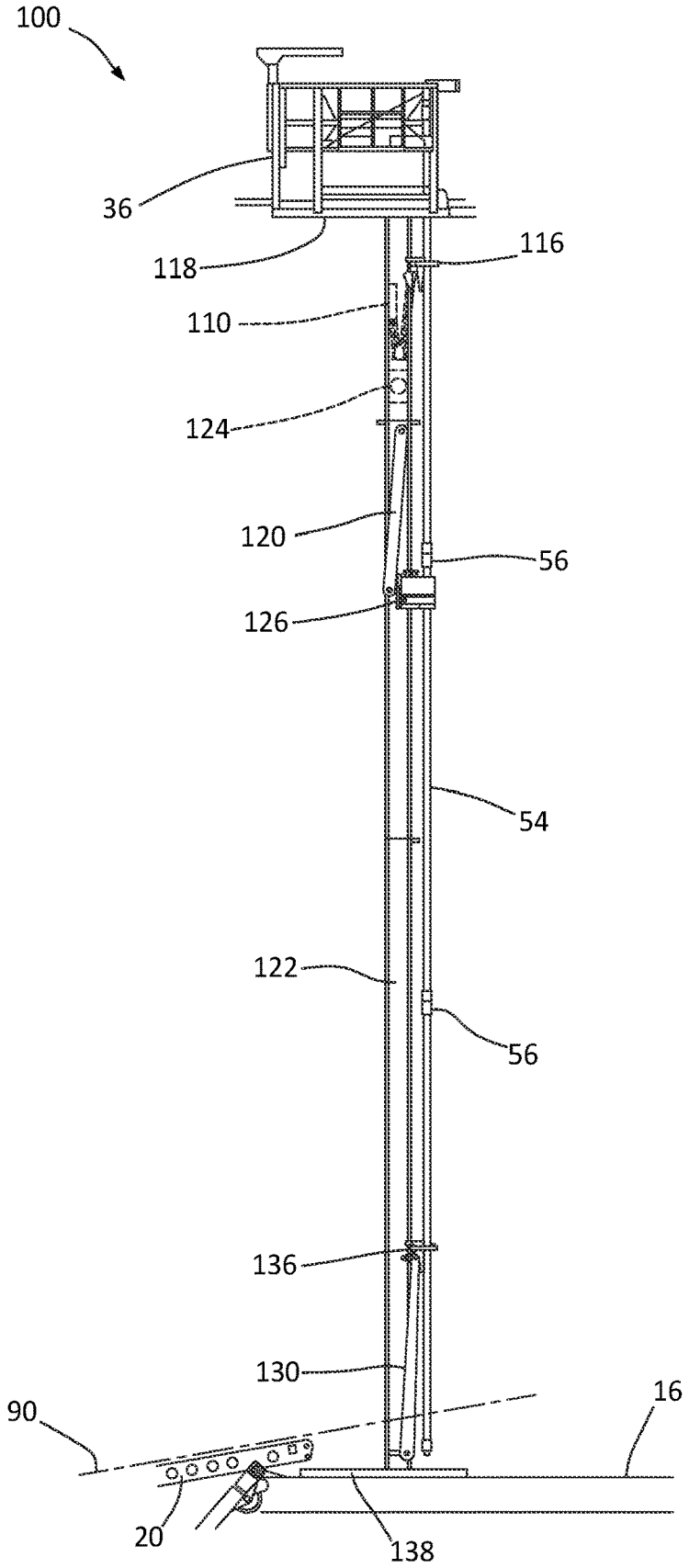
FIGS. 15A-15B are representative side views of a pipe handler retrieving a tubular (e.g., a tubular stand) from a vertical storage area and transporting the tubular along an angled track to well center or mousehole, in accordance with certain embodiments.

In FIG. 15A, the pipe handler 100 may have rotated approximately 90 degrees from a position for retrieving a tubular 54 from the vertical storage area 36, with the tubular 54 in a vertical orientation near the vertical support 122 to minimize clearance that may be desired to rotate the pipe handler 100. With pipe handler 100 rotated, the pipe handler 100 can be in position to translate along the angled upper and lower tracks 118, 138 and present the tubular 54 to the well center 24, the mousehole 26, the doping device 48, the catwalk 20, another location in the vertical storage area 36, a top drive, or an iron roughneck 38.

Figure 15B:
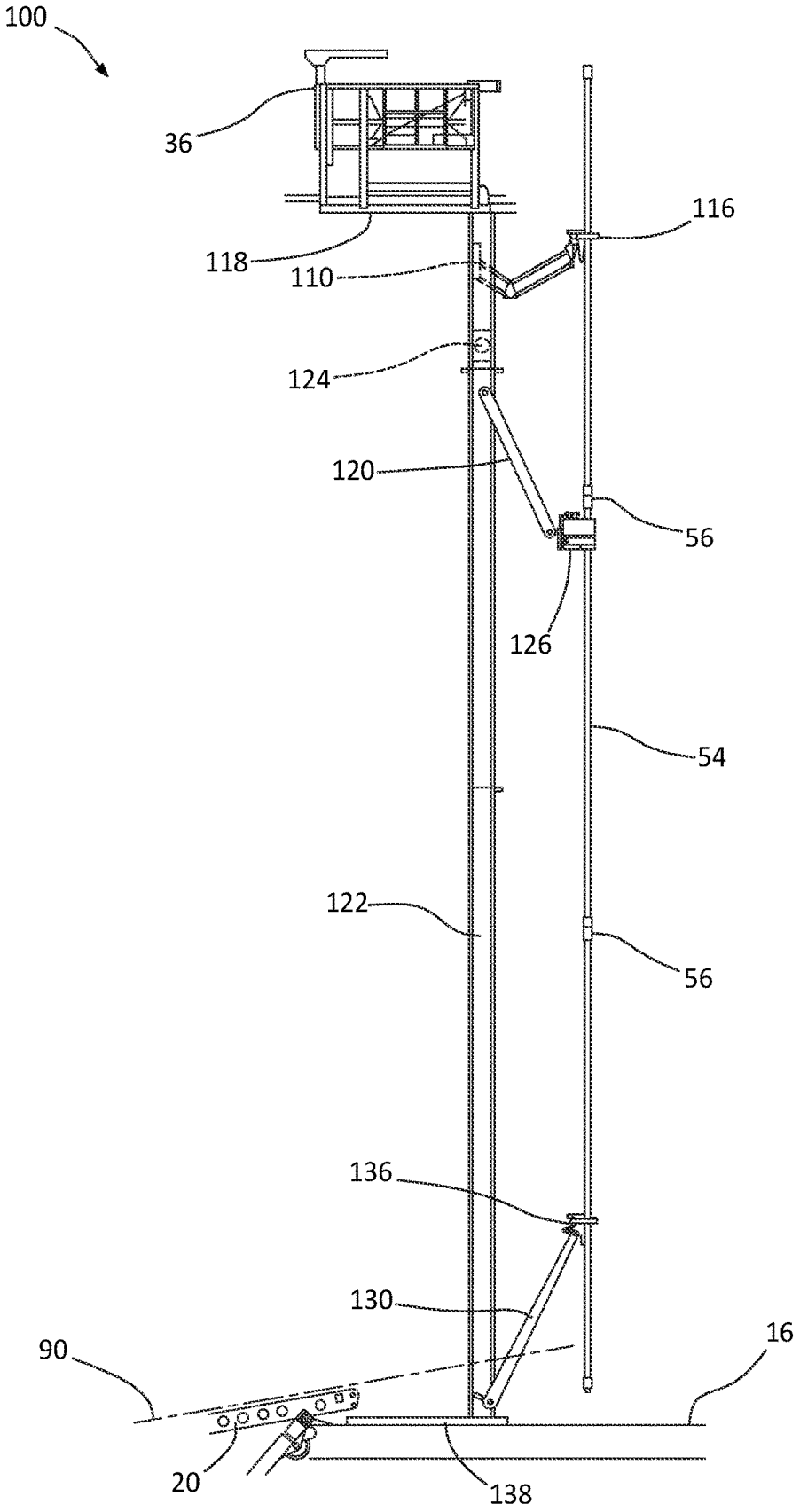

In FIG. 15B, the pipe handler 100 has moved horizontally along the angled upper track 118 and the angled lower track 138 toward the well center 24 and the arms 110, 120, 130 have been extended as needed to present the tubular 54 at the well center 24 in a vertical orientation. It should be understood that these figures can also be used to illustrate moving a tubular 54 from the well center 24 to a location in the vertical storage area 36 by reversing the operations described above regarding FIGS. 15A-15B.

Figure 16:
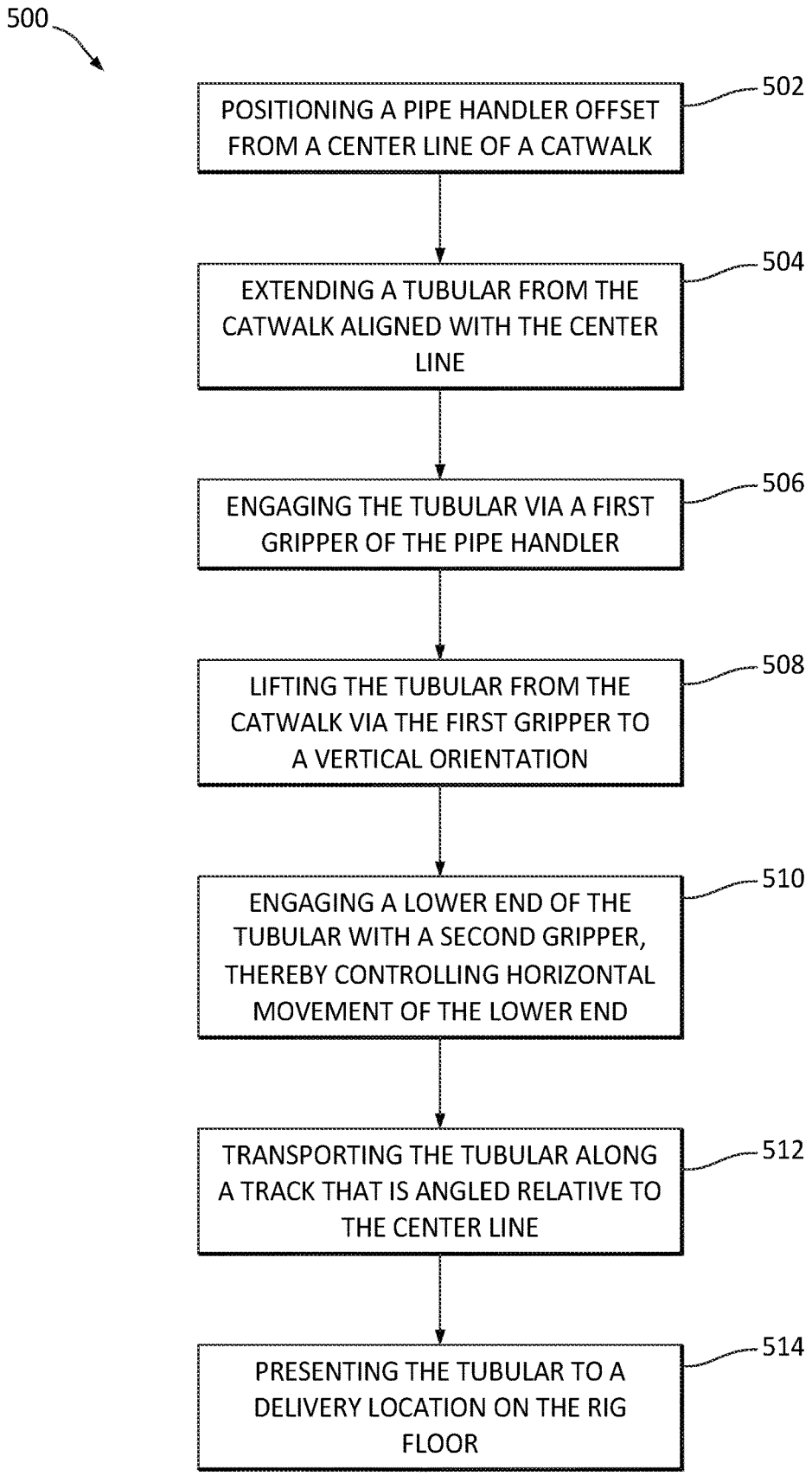
FIG. 16 is a representative flow diagram of a method 500 for handling tubulars in a subterranean operation, in accordance with certain embodiments.

FIG. 16 is a representative flow diagram of a method 500 for handling tubulars in a subterranean operation, in accordance with certain embodiments. The method 500 can include at operation 502 to position a pipe handler 100 on a rig floor 16 and offset from a center line of a catwalk at one end of the angled upper and lower tracks 118, 138. The pipe handler 100 can be coupled to an angled lower track 138 on the rig floor 16 and an angled upper track 118 underneath a fingerboard 140 of the vertical storage area 36, where a vertical support 122 of the pipe handler 100 is positioned between them and movably coupled to them. The angled upper and lower tracks 118, 138 allow the pipe handler 100 to move horizontally between the catwalk 20 and the well center 24.

In operation 504, the tubular 52 can be extended from the catwalk 20 in line with the center line 90 and positioned beside the vertical support 122 of the pipe handler 100. In operation 506, the hoisting arm 120 of the pipe handler 100 can engage the tubular 52 via a gripper 126. In operation 508 the gripper 126 can lift the tubular 52 from the catwalk 20, while in operation 510 a lower end of the tubular 52 can be engaged by a gripper 136 of the lower tailing arm 130 to control horizontal movement of the lower end as the tubular 52 is being lifted by the gripper 126 to a vertical orientation. In operation 512, the pipe handler 100 can translate along the angled upper and lower tracks 118, 138 toward the well center 24 and toward the center line 90 of the catwalk 20.

In operation 514 the pipe handler 100 can deliver the tubular 52 to a deliver location on the rig floor 16. The deliver location for receiving a tubular 52 from the catwalk 20 can be any one of the doping device 48, the mousehole 26, the well center 24, the vertical storage area 36, the top drive 18, or the iron roughneck 38, with the pickup location being the catwalk 20. For delivering the tubular 52 to the catwalk 20, a pickup location can be the doping device 48, the mousehole 26, the well center 24, the vertical storage area 36, the top drive 18, or the iron roughneck 38, with the destination location being the catwalk 20. It should be understood that any of the doping device 48, the mousehole 26, the well center 24, the vertical storage area 36, the top drive 18, the iron roughneck 38, or the catwalk 20 can be either a pickup location or a delivery location depending upon the operation being performed by the pipe handler 100.

Various Embodiments

Embodiment 1. A system for handling tubulars in a subterranean operation, the system comprising:

- a vertical support coupled to a rig floor and configured to rotate around a center axis of the vertical support relative to the rig floor;
- a hoisting arm movably coupled to the vertical support; and
- a catwalk configured to transport a tubular between a horizontal storage area and the rig floor, and wherein the hoisting arm is configured to transport the tubular between the catwalk and a well center or between the catwalk and a mousehole, wherein the vertical support is at a first azimuthal orientation relative to the center axis when the hoisting arm receives the tubular from the catwalk or delivers the tubular to the catwalk, wherein the vertical support is at a second azimuthal orientation relative to the center axis when the hoisting arm receives the tubular from a well center or mousehole, or delivers the tubular to the well center or mousehole, and wherein the first azimuthal orientation is substantially equal to the second azimuthal orientation.

Embodiment 2. The system of embodiment 1, further comprising a lower track that is disposed on the rig floor and substantially parallel to a center line of the catwalk, wherein the lower track is offset from the center line.

Embodiment 3. The system of embodiment 2, further comprising an upper track that is disposed below a fingerboard and is substantially parallel with the lower track, wherein the lower track is offset from the center line.

Embodiment 4. The system of embodiment 3, wherein the vertical support is coupled to the upper track at an upper end and the lower track at a lower end, wherein the vertical support translates horizontally relative to the upper track and the lower track.

Embodiment 5. The system of embodiment 4, wherein the vertical support is configured to rotate relative to the lower track and the upper track.

Embodiment 6. The system of embodiment 1, further comprising a lower tailing arm, wherein one end of the lower tailing arm is fixedly coupled to a lower end of the vertical support, wherein the lower tailing arm is coupled at an opposite end to a first gripper, wherein the first gripper is configured to engage a lower portion of the tubular and control horizontal movement of the lower portion of the tubular.

Embodiment 7. The system of embodiment 6, wherein the hoisting arm and the lower tailing arm cooperate with each other to manipulate the tubular about the rig floor.

Embodiment 8. The system of embodiment 7, wherein the lower tailing arm is configured to allow vertical movement of the tubular while the hoisting arm raises or lowers the tubular.

Embodiment 9. The system of embodiment 7, further comprising an upper tailing arm, wherein one end of the upper tailing arm is fixedly coupled to an upper end of the vertical support, wherein the upper tailing arm is coupled at an opposite end to a first gripper, wherein the first gripper is configured to engage a top portion of a tubular and control horizontal movement of the top portion of the tubular.

Embodiment 10. The system of embodiment 9, wherein the hoisting arm, the lower tailing arm, and the upper tailing arm cooperate with each other to manipulate the tubular about the rig floor.

Embodiment 11. The system of embodiment 10, wherein the upper tailing arm is configured to allow vertical movement of the tubular while the hoisting arm raises or lowers the tubular.

Embodiment 12. The system of embodiment 1, further comprising a doping device positioned on the rig floor, and wherein the hoisting arm is configured to lower an end of the tubular into the doping device and raise the end of the tubular from the doping device after dope is applied to threads of the end of the tubular.

Embodiment 13. The system of embodiment 1, further comprising a hoist fixedly coupled to the vertical support, wherein the hoisting arm further comprises a base that is movably coupled to the vertical support, and wherein the hoist controls vertical movement of the base along the vertical support and thereby controls vertical movement of the hoisting arm relative to the vertical support.

Embodiment 14. The system of embodiment 1, wherein the hoisting arm is configured to transport the tubular between the catwalk and the well center or between the catwalk and the mousehole while the vertical support maintains a substantially constant azimuthal orientation relative to the center axis.

Embodiment 15. A method for handling tubulars in a subterranean operation, the method comprising:

movably coupling a vertical support of a pipe handler to a rig floor, such that the vertical support is configured to horizontally translate along the rig floor and to rotate around a center axis relative to the rig floor;

movably coupling a hoisting arm to the vertical support;

extending a portion of a tubular from a catwalk along a center line of the catwalk to vertically below the hoisting arm;

engaging the portion of the tubular via the hoisting arm; and via the hoisting arm, receiving the tubular from the catwalk or delivering the tubular to the catwalk at a first azimuthal orientation; and via the hoisting arm, delivering the tubular to or receiving the tubular from a delivery location on the rig floor at a second azimuthal orientation, wherein the first azimuthal orientation is substantially equal to the second azimuthal orientation.

Embodiment 16. The method of embodiment 15, further comprising vertically lowering the hoisting arm along the vertical support; and engaging the tubular via a gripper coupled to the hoisting arm.

Embodiment 17. The method of embodiment 15, further comprising translating the tubular from the catwalk to a delivery location while maintaining a constant azimuthal orientation of the vertical support.

Embodiment 18. The method of embodiment 17, wherein the delivery location comprises one of a well center, a mousehole, a doping device, a location in a vertical storage area, an iron roughneck, or a top drive.

Embodiment 19. The method of embodiment 15, further comprising:

aligning a lower track in parallel with the center line of the catwalk;

offsetting the lower track from the center line; and translating the vertical support along the lower track.

Embodiment 20. The method of embodiment 19, further comprising:

receiving a first tubular from the catwalk via the pipe handler at the first azimuthal orientation;

delivering the first tubular to a mousehole via the pipe handler at the second azimuthal orientation;

receiving a second tubular from the catwalk via the pipe handler at the first azimuthal orientation;

delivering the second tubular to the mousehole via the pipe handler at the second azimuthal orientation;

connecting the first tubular to the second tubular at the mousehole to form a tubular stand; and retrieving the tubular stand from the mousehole via the pipe handler; and delivering the tubular stand to a location in a vertical storage area via the pipe handler.

Embodiment 21. The method of embodiment 19, further comprising:

receiving a first tubular from the catwalk via the pipe handler at the first azimuthal orientation;

delivering the first tubular to a doping device in a vertical orientation via the pipe handler at the second azimuthal orientation;

lowering an end of the first tubular into the doping device; and delivering the first tubular to a mousehole or a well center via the pipe handler at the second azimuthal orientation.

Embodiment 22. A system for handling tubulars in a subterranean operation, the system comprising:

a vertical storage area configured to store vertically oriented tubulars on a rig floor;

a vertical support of a pipe handler movably coupled to the rig floor and a fingerboard;

an upper tailing arm rotationally coupled to an upper portion of the vertical support, wherein the upper tailing arm is configured to extend a maximum first horizontal distance from the vertical support; and a hoisting arm moveably coupled to the vertical support below the upper tailing arm, wherein the hoisting arm is configured to lift an entire weight of a tubular, wherein the hoisting arm is configured to extend a maximum second horizontal distance from the vertical support, and wherein the first maximum horizontal distance is greater than the second maximum horizontal distance.

Embodiment 23. The system of embodiment 22, wherein the hoisting arm is rotationally coupled to the vertical support and vertically movable relative to the vertical support.

Embodiment 24. The system of embodiment 22, further comprising:

extending the upper tailing arm from the vertical support a first horizontal distance;

engaging the tubular with a first gripper, wherein the first gripper is coupled to an end of the upper tailing arm;

retracting the upper tailing arm; and leaning the tubular toward the vertical support.

Embodiment 25. The system of embodiment 24, further comprising:

extending the hoisting arm a second horizontal distance away from the vertical support, wherein the second horizontal distance is less than the first horizontal distance;

engaging the tubular with a second gripper that is coupled to an end of the hoisting arm; and lifting the tubular upward to raise a lower end of the tubular from the rig floor.

Embodiment 26. The system of embodiment 25, further comprising:

prior to lifting the tubular, engaging, via a lower tailing arm, a lower portion of the tubular to control horizontal movement of the lower portion of the tubular.

Embodiment 27. The system of embodiment 26, wherein engaging the lower portion of the tubular comprises engaging the lower portion with a third gripper coupled to one end of the lower tailing arm.

Embodiment 28. The system of embodiment 26, further comprising:

retracting the hoisting arm and the lower tailing arm toward the vertical support, wherein the tubular is moved from a tilted orientation to a vertical orientation.

Embodiment 29. The system of embodiment 28, wherein the first gripper of the upper tailing arm remains at a constant horizontal position while retracting the hoisting arm and the lower tailing arm toward the vertical support.

Embodiment 30. A method for handling tubulars in a subterranean operation, the method comprising:

movably coupling a vertical support of a pipe handler to an upper track in a fingerboard;

extending an upper tailing arm a first horizontal distance from the vertical support and engaging an upper portion of a tubular with the upper tailing arm, wherein the upper tailing arm is coupled to the vertical support, and wherein the tubular is positioned in a location of a vertical storage area;

retracting the upper tailing arm to move the upper portion of the tubular proximate the vertical support; and extending a hoisting arm a second horizontal distance to engage a middle portion of the tubular, wherein the hoisting arm is coupled to the vertical support, and wherein the second horizontal distance is less than the first horizontal distance.

Embodiment 31. The method of embodiment 30, further comprising:

engaging a lower portion of the tubular via a lower tailing arm that is rotationally coupled to the vertical support; and lifting the tubular via the hoisting arm, wherein the tubular moves vertically relative to the lower tailing arm while the tubular is being lifted by the hoisting arm.

Embodiment 32. The method of embodiment 31, further comprising:

retracting the hoisting arm and the lower tailing arm toward the vertical support, thereby positioning the tubular in a substantially vertical orientation at a first radial position relative to a center axis of the vertical support.

Embodiment 33. The method of embodiment 32, further comprising:

rotating the vertical support about the center axis; and transporting the vertical support along the upper track to deliver, via the hoisting arm, the tubular to a catwalk, to another location in the vertical storage area, to a mousehole, to a doping device, to an iron roughneck, or to a top drive.

Embodiment 34. The method of embodiment 33, further comprising extending the upper tailing arm, the lower tailing arm, and the hoisting arm to position the tubular at a second radial position relative to a center axis of the vertical support, wherein the second radial position is greater than the first radial position.

Embodiment 35. A system for handling tubulars in a subterranean operation, the system comprising:

a catwalk configured to transport a tubular between a horizontal storage area and a rig floor; and a vertical support coupled to a rig floor via an angled lower track, wherein the vertical support is configured to rotate around a center axis of the vertical support relative to the rig floor and translate along the angled lower track, wherein the angled lower track is horizontally angled relative to a center line of the catwalk; and a hoisting arm movably coupled to the vertical support, wherein the hoisting arm is configured to transport the tubular between the catwalk and a well center or between the catwalk and a mousehole along the angled lower track.

Embodiment 36. The system of embodiment 35, further comprising an angled upper track that is disposed below a fingerboard and is substantially parallel with the angled lower track, wherein one end of the angled lower track is offset from the center line.

Embodiment 37. The system of embodiment 36, wherein the vertical support is coupled to the angled upper track at an upper end and the angled lower track at a lower end, wherein the vertical support translates horizontally relative to the angled upper track and the angled lower track.

Embodiment 38. The system of embodiment 37, wherein the vertical support is configured to rotate relative to the angled lower track and the angled upper track.

Embodiment 39. The system of embodiment 35, further comprising a lower tailing arm, wherein one end of the lower tailing arm is fixedly coupled to a lower end of the vertical support, wherein the lower tailing arm is coupled at an opposite end to a first gripper, wherein the first gripper is configured to engage a lower portion of the tubular and control horizontal movement of the lower portion of the tubular.

Embodiment 40. The system of embodiment 39, wherein the hoisting arm and the lower tailing arm cooperate with each other to manipulate the tubular about the rig floor.

Embodiment 41. The system of embodiment 40, wherein the lower tailing arm is configured to allow vertical movement of the tubular while the hoisting arm raises or lowers the tubular.

Embodiment 42. The system of embodiment 40, further comprising an upper tailing arm, wherein one end of the upper tailing arm is fixedly coupled to an upper end of the vertical support, wherein the upper tailing arm is coupled at an opposite end to a first gripper, wherein the first gripper is configured to engage a top portion of a tubular and control horizontal movement of the top portion of the tubular.

Embodiment 43. The system of embodiment 42, wherein the hoisting arm, the lower tailing arm, and the upper tailing arm cooperate with each other to manipulate the tubular about the rig floor.

Embodiment 44. The system of embodiment 43, wherein the upper tailing arm is configured to allow vertical movement of the tubular while the hoisting arm raises or lowers the tubular.

Embodiment 45. The system of embodiment 35, further comprising a doping device positioned on the rig floor, and wherein the hoisting arm is configured to lower an end of the tubular into the doping device and raise the end of the tubular from the doping device after dope is applied to threads of the end of the tubular.

Embodiment 46. The system of embodiment 35, further comprising a hoist fixedly coupled to the vertical support, wherein the hoisting arm further comprises a base that is movably coupled to the vertical support, and wherein the hoist controls vertical movement of the base along the vertical support and thereby controls vertical movement of the hoisting arm relative to the vertical support.

Embodiment 47. The system of embodiment 35, wherein the hoisting arm is configured to transport the tubular between the catwalk and the well center or between the catwalk and the mousehole while the vertical support maintains a substantially constant azimuthal orientation relative to the center axis.

Embodiment 48. A method for handling tubulars in a subterranean operation, the method comprising:

movably coupling a vertical support of a pipe handler to an upper track in a fingerboard and a lower track on a rig floor, wherein the upper track and the lower track are substantially parallel with each other, and wherein the upper track and the lower track are horizontally angled relative to a center line of a catwalk;

receiving or retrieving a tubular from a pickup location via the pipe handler by engaging the tubular with the pipe handler;

holding the tubular in a vertical orientation at a first radial distance from a center axis of the vertical support;

transporting the tubular along the upper track and the lower track; and delivering the tubular to a delivery location via the pipe handler.

Embodiment 49. The method of embodiment 48, wherein the pickup location comprises one of the catwalk, a location in the fingerboard, a mousehole, a doping device, a top drive, or an iron roughneck, and wherein the delivery location comprises one of the catwalk, another location in the fingerboard, the mousehole, the doping device, the top drive, or the iron roughneck.

Embodiment 50. The method of embodiment 48, further comprising:

engaging a tubular with at least one of an upper tailing arm, a lower tailing arm, and a hoisting arm, wherein each are rotationally coupled to the vertical support.

Embodiment 51. The method of embodiment 50, wherein the upper tailing arm is configured to engage an upper portion of the tubular, the lower tailing arm is configured to engage a lower portion of the tubular, and the hoisting arm is configured to engage a middle portion of the tubular.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

What is claimed is:

1. A system for handling tubulars in a subterranean operation, the system comprising:

a vertical support coupled to a rig floor and configured to rotate around a center axis of the vertical support relative to the rig floor;

a hoisting arm movably coupled to the vertical support;

a catwalk configured to transport a tubular between a horizontal storage area and the rig floor, wherein the hoisting arm is configured to transport the tubular between the catwalk and a well center or between the catwalk and a mousehole, wherein the vertical support is at a first azimuthal orientation relative to the center axis when the hoisting arm receives the tubular from the catwalk, wherein the vertical support is at a second azimuthal orientation relative to the center axis when the hoisting arm delivers the tubular to the well center or the mousehole, and wherein the first azimuthal orientation is substantially equal to the second azimuthal orientation;

a lower track that is disposed on the rig floor and substantially parallel to a center line of the catwalk, wherein the lower track is horizontally offset from the center line; and an upper track that is disposed below a fingerboard and is substantially parallel with the lower track, wherein the upper track is horizontally offset from the center line.

2. The system of claim 1, wherein the vertical support is coupled to the upper track at an upper end and the lower track at a lower end, wherein the vertical support translates horizontally relative to the upper track and the lower track, and wherein the vertical support is configured to rotate relative to the lower track and the upper track.

3. A system for handling tubulars in a subterranean operation, the system comprising:

a vertical support coupled to a rig floor and configured to rotate around a center axis of the vertical support relative to the rig floor;

a hoisting arm movably coupled to the vertical support;

a catwalk configured to transport a tubular between a horizontal storage area and the rig floor, wherein the hoisting arm is configured to transport the tubular between the catwalk and a well center or between the catwalk and a mousehole, wherein the vertical support is at a first azimuthal orientation relative to the center axis when the hoisting arm receives the tubular from the catwalk, wherein the vertical support is at a second azimuthal orientation relative to the center axis when the hoisting arm delivers the tubular to the well center of the mousehole, and wherein the first azimuthal orientation is substantially equal to the second azimuthal orientation;

a lower tailing arm, wherein one end of the lower tailing arm is fixedly coupled to a lower end of the vertical support, wherein the lower tailing arm is coupled at an opposite end to a first gripper, wherein the first gripper is configured to engage a lower portion of the tubular and control horizontal movement of the lower portion of the tubular, and wherein the hoisting arm and the lower tailing arm cooperate with each other to manipulate the tubular about the rig floor; and an upper tailing arm, wherein one end of the upper tailing arm is fixedly coupled to an upper end of the vertical support, wherein the upper tailing arm is coupled at an opposite end to a first gripper, wherein the first gripper is configured to engage a top portion of a tubular and control horizontal movement of the top portion of the tubular.

4. The system of claim 3, wherein the lower tailing arm is configured to allow vertical movement of the tubular while the hoisting arm raises or lowers the tubular.

5. The system of claim 3, wherein the hoisting arm, the lower tailing arm, and the upper tailing arm cooperate with each other to manipulate the tubular about the rig floor, and wherein the upper tailing arm is configured to allow vertical movement of the tubular while the hoisting arm raises or lowers the tubular.

6. The system of claim 1, further comprising a doping device positioned on the rig floor, and wherein the hoisting arm is configured to lower an end of the tubular into the doping device and raise the end of the tubular from the doping device after dope is applied to threads of the end of the tubular.

7. A method for handling tubulars in a subterranean operation, the method comprising:

movably coupling a vertical support of a pipe handler to a rig floor, such that the vertical support is configured to horizontally translate along the rig floor and to rotate around a center axis relative to the rig floor;

movably coupling a hoisting arm to the vertical support;

extending a portion of a tubular from a catwalk along a center line of the catwalk to be positioned vertically below the hoisting arm;

engaging the portion of the tubular via the hoisting arm;

via the hoisting arm, receiving the tubular from the catwalk at a first azimuthal orientation;

via the hoisting arm, delivering the tubular to a delivery location on the rig floor at a second azimuthal orientation, wherein the first azimuthal orientation is substantially equal to the second azimuthal orientation;

aligning a lower track in parallel with the center line of the catwalk;

offsetting the lower track from the center line; and translating the vertical support along the lower track.

8. The method of claim 7, further comprising translating the tubular from the catwalk to a delivery location while maintaining a constant azimuthal orientation of the vertical support.

9. The method of claim 7, wherein the delivery location comprises one of a well center, a mousehole, a doping device, a location in a vertical storage area, an iron roughneck, or a top drive.

10. A system for handling tubulars in a subterranean operation, the system comprising:

a vertical storage area configured to store tubulars on a rig floor that are substantially vertically oriented;

a vertical support of a pipe handler movably coupled to the rig floor and a fingerboard;

an upper tailing arm rotationally coupled to an upper portion of the vertical support, wherein the upper tailing arm is configured to extend a maximum first horizontal distance from the vertical support; and a hoisting arm moveably coupled to the vertical support below the upper tailing arm, wherein the hoisting arm is configured to lift an entire weight of a tubular and extend a maximum second horizontal distance from the vertical support, and wherein the first maximum horizontal distance is greater than the second maximum horizontal distance;

a first gripper that is coupled to an end of the upper tailing arm, wherein the upper tailing arm is configured to extend a first horizon distance from the vertical support, engage an upper portion of the tubular in the vertical storage area with the first gripper, and control horizontal movement of the upper portion of the tubular, a second gripper that is coupled to an end of the hoisting arm, wherein the hoisting arm is configured to extend a second horizontal distance from the vertical support, engage the tubular with the second gripper, lift the tubular upward, and raise a lower end of the tubular from the rig floor, and wherein the second horizontal distance is less than the first horizontal distance; and a lower tailing arm with a third gripper coupled to one end of the lower tailing arm, wherein the lower tailing arm is configured to engage a lower portion of the tubular with the third gripper and control horizontal movement of the lower portion of the tubular.

11. The system of claim 10, wherein the hoisting arm is rotationally coupled to the vertical support and vertically movable relative to the vertical support.

12. The system of claim 10, wherein the hoisting arm and the lower tailing arm are configured to retract toward the vertical support and move the tubular from a tilted orientation to a vertical orientation when the tubular is removed from the vertical storage area.

* * * * *